US010141633B2

(12) United States Patent
Cheng et al.

(10) Patent No.: US 10,141,633 B2
(45) Date of Patent: Nov. 27, 2018

(54) MULTIBAND MICROLINE ANTENNA

(71) Applicants: ZTE Corporation, Shenzhen (CN); ZTE Canada Inc., Toronto (CA)

(72) Inventors: Dajun Cheng, Kanata (CA); Di Xie, Kanata (CA); Hongwei Zhang, Shanxi (CN)

(73) Assignees: ZTE Corporation, Shenzhen (CN); ZTE Canada Inc., Toronto, Ontario (CA)

( * ) Notice: Subject to any disclaimer, the term of this patent is extended or adjusted under 35 U.S.C. 154(b) by 263 days.

(21) Appl. No.: 15/249,034

(22) Filed: Aug. 26, 2016

(65) Prior Publication Data

US 2017/0062938 A1 Mar. 2, 2017

(30) Foreign Application Priority Data

Aug. 28, 2015 (WO) ..... PCT/CN2015/088403

(51) Int. Cl.
*H01Q 9/42* (2006.01)
*H01Q 1/24* (2006.01)

(52) U.S. Cl.
CPC ..... *H01Q 1/243* (2013.01); *H01Q 9/42* (2013.01)

(58) Field of Classification Search
CPC ..... H01Q 1/243; H01Q 9/42
USPC ..... 343/700 MS
See application file for complete search history.

(56) References Cited

U.S. PATENT DOCUMENTS 6,077,073 A * 6/2000 Jacob ..... A61C 19/066 433/29

* cited by examiner

*Primary Examiner* — Andrea Lindgren Baltzell
(74) *Attorney, Agent, or Firm* — Perkins Coie LLP

(57) ABSTRACT

A multiband antenna includes a plurality of radiation elements, operative within different frequency bands. The multiband microline antenna includes a base substrate that has a signal feeding trace and a partial ground plane, and two or more additional substrates that have multiple microline radiation elements electromagnetically coupled to the signal feeding trace. Each microline radiation element has a width not greater than 0.1 millimeter, and varies in length and resonant frequency. Various disclosed embodiments include a multiband microline folded monopole antenna, a multiband microline loop antenna, a multiband microline inverted-F antenna and a multiband microline π-shaped antenna.

59 Claims, 16 Drawing Sheets

400

Phi=0

402

Phi=90

700

MULTIBAND MICROLINE ANTENNA

CROSS REFERENCE TO RELATED APPLICATIONS

This patent document claims the benefit of priority under 35 U.S.C. §119(a) and the Paris Convention of International Patent Application No. PCT/CN2015/088403, filed on Aug. 28, 2015. The entire contents of the before-mentioned patent applications are incorporated by reference as part of the disclosure of this patent document.

TECHNICAL FIELD

This patent document relates to wireless communication and in particular to antennas for receiving or transmitting wireless signals.

BACKGROUND

Many mobile wireless devices have been developed and are being designed that are capable of operation within multiple frequency bands. Examples of multiple radio frequency bands include but are not limited to bands 1/2/3/5/7/8/26/34/38/39/40/41 to cover the cellular communication technologies of GSM/CDMA/WCDMA/TD-SCDMA/LTE, GPS, ISM 2.4 GHz and 5 GHz bands for Wi-Fi and Bluetooth applications.

A variety of antennas that can operate in multiple frequency bands (multiband antennas) have been developed to facilitate multiband operation of various wireless communication technologies. However, the prior art of the multiband small antennas are typically placed on the back cover of the mobile wireless device, wherein the antenna traces are made of conductive stripes and lack of the visual transparency. In some particular form-factor design, there is design desire and requirement to have a multiband antenna that have improved visual transparency.

SUMMARY

In the following description, embodiments of multiband antennas with a plurality of radiation elements of microlines are disclosed. In some embodiments, the width of each of the radiation elements is small enough to not obstruct a user's view, e.g., not greater than 0.1 millimeter. In one beneficial aspect, the disclosed embodiments could significantly improve the visual transparency of the antenna structure when the antenna base substrate, antenna trace substrates, and the housing of the mobile wireless devices are made of transparent or translucent materials, compared to conventional designs.

In some embodiments, of a multiband microline antenna, a plurality of microline radiation elements are designed to operate in multiple frequency bands. In some embodiments, a multiband microline antenna includes a base substrate that has a signal feeding trace and a partial ground plane, and two or more substrates that have a plurality of microline radiation elements electromagnetically coupled to the signal feeding trace. In some embodiments, the width of each of the microline radiation elements is not greater than 0.1 millimeter, and hence may significantly improve the visual transparency of the antenna structure. To improve the operation bandwidth in each of the operating frequency bands, the plurality of microline radiation elements may be grouped such that each of the microline radiation elements have slightly different resonant frequency and each group of the microline radiation elements has a target operating bandwidth. Also, the multiband microline antenna with multiple layers could be implemented to further increase the numbers of the operating bands and improve the operating bandwidth in each of the frequency bands.

This and other aspects and their implementations are described in greater detail in the drawings, the description and the claims.

DETAILED DESCRIPTION

Figure 1A:
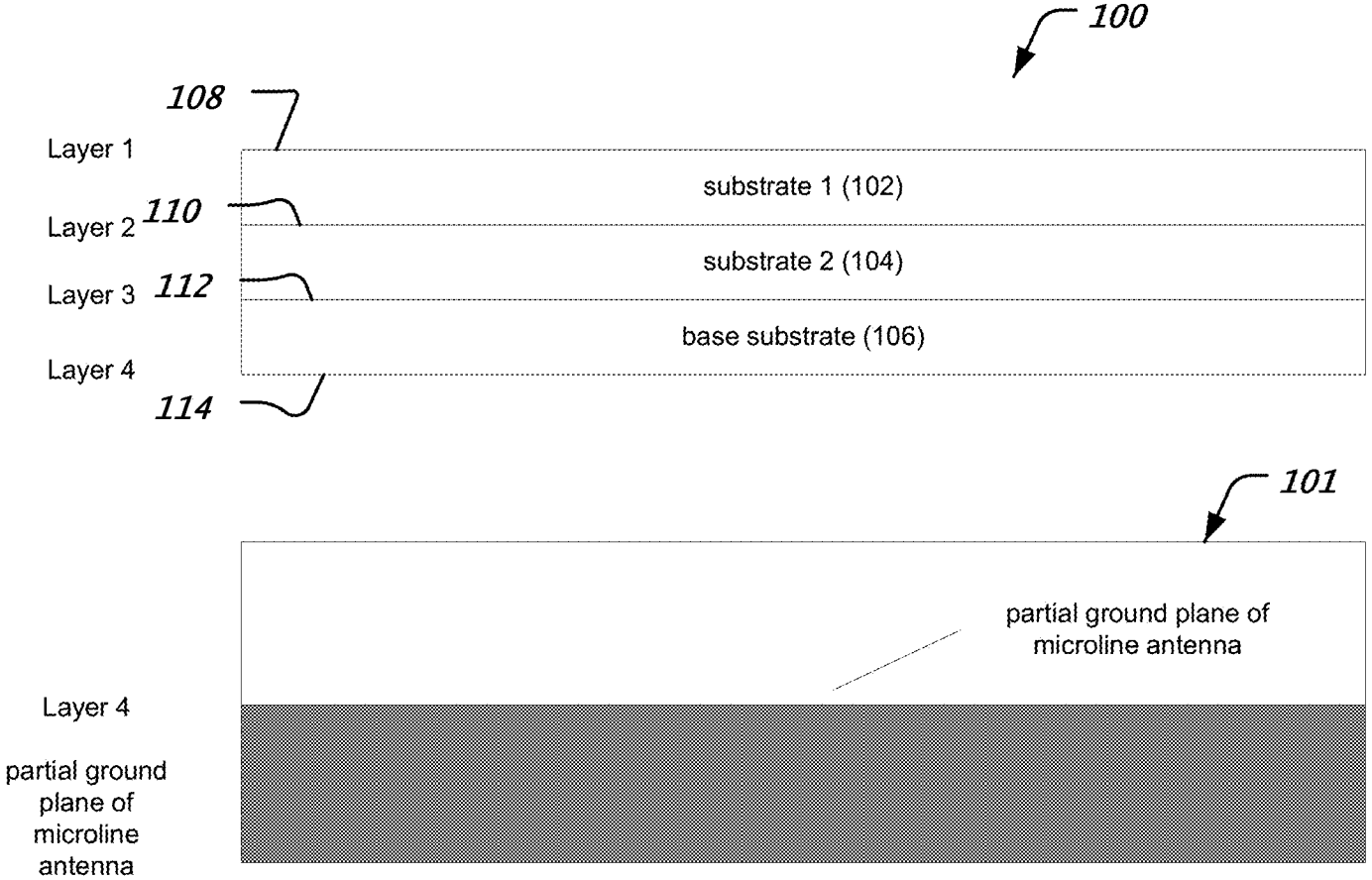
FIG. 1A schematically illustrates an example cross section of a multiband antenna.

Mobile wireless devices are fast becoming an important tool for users for performing a number of tasks including making phone calls, downloading and watching audio and video, and connecting to the Internet. One feature that many wireless device have to make them universally usable is the ability to connect with other users or the Internet using multiple different radio frequency (RF) communication networks. For example, a user device that operates via a Long Term Evolution (LTE) network and also via a local area network such as Wi-Fi.

One challenge is that mobile wireless devices equipped to operate using multiple RF interfaces, include antenna to receive and transmit wireless signals. The techniques described in the present document can be used to design an antenna that can be positioned on a mobile wireless device in a manner that is non-obtrusive to a user's use of the mobile wireless device. This document discloses, among other techniques, structures and fabrication processes for microline antenna arrays.

The mobile wireless devices referred to herein include but are not limited to a cellular phone, a portable multimedia player, a tablet, a handheld device, a mobile TV, a portable GPS device, or any other types of devices that have cellular and/or any other wireless communication capabilities.

Embodiments are provided that include: multiband microline folded monopole antenna, multiband microline loop antenna, multiband microline inverted-F antenna, and multiband microline π-shaped antenna.

In one aspect, the multiband microline radiation elements have a common feeding arm and are fed with the signal line trace by the trans-through micro-via between the substrates. The micro-via has a diameter of not greater than 0.1 millimeter, and is filled with conductive material, e.g., silver or copper.

And in another aspect, the multiband microline radiation elements could have a common coupling arm and are fed with the signal line by the direct coupling, wherein the signal line trace includes a coupling pad in the coupling area and the signals are electromagnetically coupled with the microline radiation elements.

To improve the impedance matching for multiband operation, impedance matching radio frequency circuit could be used in the feeding line of the multiband microline antenna. The impedance matching radio frequency circuit may comprise of discrete components of capacitors or inductors, or transmission line stubs, or a circuit switch with tunable discrete components.

To make the operation band adjustable and decrease the overall size of the multiband microline antenna, in some of the embodiments, a ground pad that electromagnetically connects the radiation elements and the partial ground plane could be loaded with a tunable capacitor, or a single-pole-multiple-throw (SPxT) switch loaded with capacitors of different values so that the resonant frequency of each radiation elements are adjustable.

Example applications of the multiband microline antenna in a mobile wireless device are provided that could support multiband multimode radio communication protocol and carrier aggregation. The multiband microline antenna, as disclosed in this document, could be used to transmit and/or receive multiband radio signals that include but are not limited to the radio signals of GSM, CDMA, WCDMA, TD-SCDMA, LTE TDD, LTE FDD, Wi-Fi, Bluetooth, and GPS.

A multiband microline antenna, as disclosed in this document, could also be used as the secondary antenna for multiple-in-multiple-out (MIMO) and/or frequency diversity and/or space diversity application in a mobile wireless device.

The present document also provides example applications of the multiband microline antenna in a mobile wireless device that has a secondary display that is transparent or translucent and the multiband microline antenna including transparent or translucent substrates placed on the back side of the secondary display.

In some embodiments, a mobile device is provided with a small opening aperture with visual transparency in the bottom portion of the device. The back side of the small opening includes the multiband microline antenna. The base substrate and substrates of the multiband microline antenna may be made from a transparent or translucent materials. The housing of the mobile device may comprise a transparent or translucent material at least in the bottom portion of the device. The small opening aperture has transparent or translucent cover layers in the front and back. Inside the small opening aperture, at least one of the light-based sensors may be included.

Embodiments are provided for multiband microline antenna, wherein the width of each of the radiation elements is not greater than 0.1 millimeter, and hence would significantly improve the visual transparency of the antenna structure when the antenna base substrate, radiation element substrates, and the housing of the mobile wireless device are made of transparent or translucent materials.

Descriptions such as "Band 1", "Band 2", etc. are used in the description solely for the purpose of identifying and distinguishing between the radio frequency bands in the description, and are not intended to signify a particular operating frequency band or an order of frequency occupied by the bands in the spectrum.

FIG. 1 schematically illustrates an example embodiment of a multiband microline folded monopole antenna 100. The antenna 100 includes one or more groups of radiation elements that are composed of a plurality of microline radiation elements. Each of the radiation element may be a microline folded monopole. In some embodiments, each element of the microline folded monopole has the width not greater than 0.1 millimeter, and has a length of a quarter wavelength of the operating frequency for the frequency band for which the antenna is designed to operate. In some embodiments, each of the plurality of the microline radiation elements has slightly different length and the resonant frequency of each of the microline radiation element is slightly different. For example, when Band 1 is in the Giga Hertz range, then resonant frequencies of each microline may be 5 to 10 MHz apart. In this way, the overall operation bandwidth of the plurality of the microline radiation elements are extended to have the desired operation bandwidth.

Figure 1B:
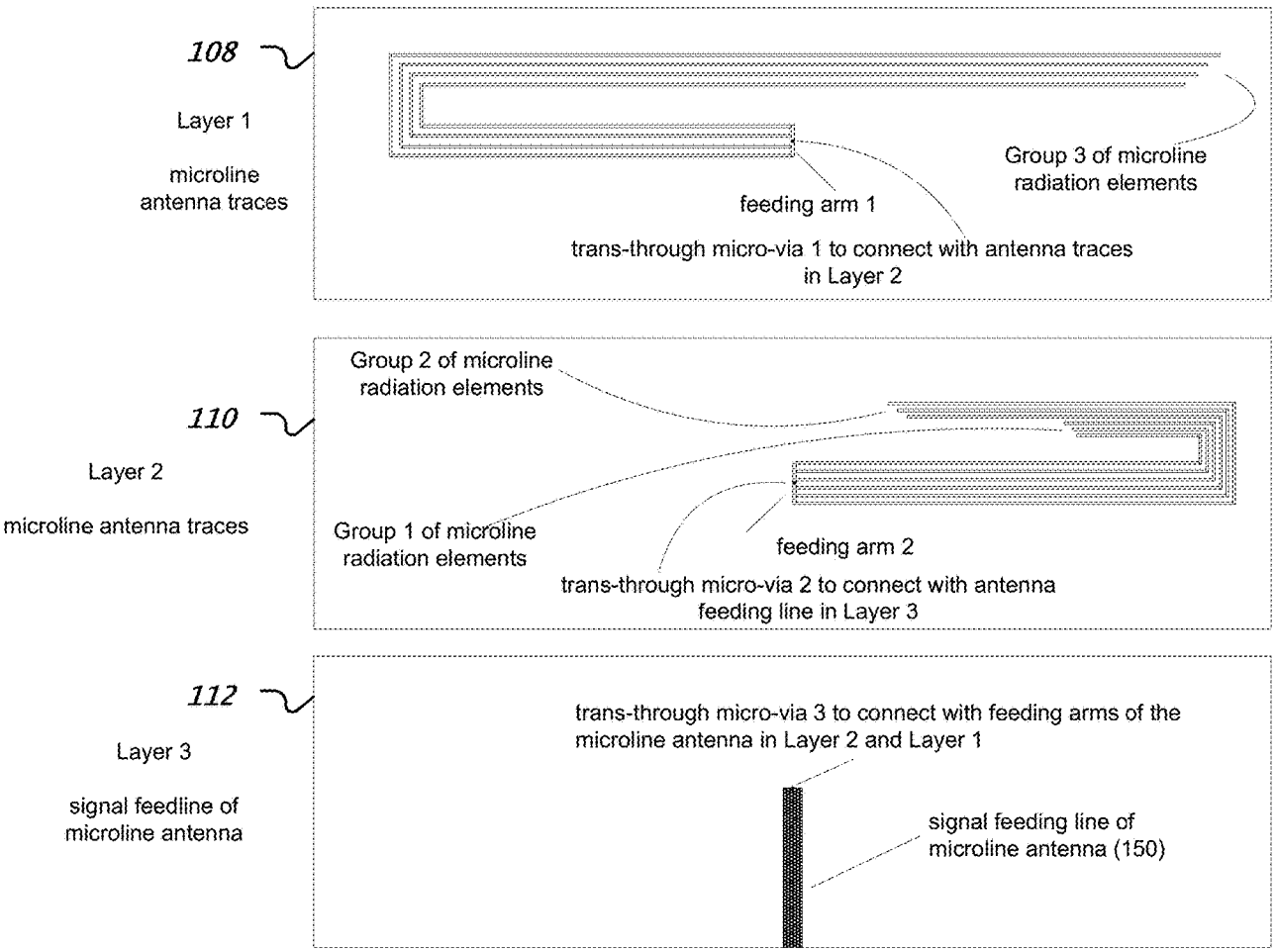
FIG. 1B schematically illustrates an example embodiment of a multiband folded monopole antenna.

As shown in FIG. 1A and FIG. 1B, a four-layered (108, 110, 112, 114) microline folded monopole antenna may be constructed. As depicted in a plan view 101, Layer 4 (114) has a partial ground metallic plane of the antenna. Layer 3 (112) may be on top of layer 4 and the signal feeding trace (150) is placed in Layer 3. The first and second plurality of microline radiation elements are placed in Layer 2 (110) and the third plurality of microline radiation elements are located in Layer 1, which is on top of Layer 2. The layers are separated by corresponding substrates 102, 104, 106 of insulating material.

The first and second plurality of the microline radiation elements in Layer 2 are electrically connected in the feeding arm at the end of the radiation elements, and a trans-through micro-via is placed between Layer 2 and Layer 3 with a filling of conductive material to electrically connected the signal feeding trace and the feeding arm of the first and second plurality of microline radiation elements. The third plurality of the microline radiation elements in Layer 1 are electrically connected in the feeding arm at the end of the radiation elements, and a trans-through micro-via is placed through Layer 1, Layer 2, and Layer 3 with a filling of conductive material to electrically connected the feeding signal and the feeding arm of these microline radiation elements in Layer 1.

In FIG. 1A and FIG. 1B, the trans-through micro-vias are used to electrically connect the feeding arms of the plurality of the microline radiation elements with the signal feeding line. The stacked micro-via that cross over multilayered substrates includes a filling of conductive material and has a diameter of not greater than 0.1 millimeter.

Although two substrates (102, 104) of radiation elements are illustrated in FIG. 1A and FIG. 1B, it will be appreciated by one of skill in the art that more substrates could be used for a multiband antenna, wherein the each of the substrates could include a plurality of conductive microline radiation elements and are electromagnetically coupled to the signal feeding trace.

In some embodiments, to further extend the operation bandwidth of a particular frequency band, one or more microline radiation elements can be added in a multilayered substrate structure. The microline radiation elements in Layer 1/2 may have a slightly different length from the other microline radiation elements in Layer 1/2.

In some embodiments, to increase the operating frequency bands, a plurality of microline radiation elements would be further added in a multilayered structure, wherein each of the microline radiation elements in the substrate layer has a different length and resonant frequencies from the other microline radiation elements in Layer 1/2.

In some embodiments, the microline elements in a coplanar layer could include branches, wherein each of the branches comprises of a group of microlines and each group of the microlines corresponds to an operating frequency band.

Figure 2:
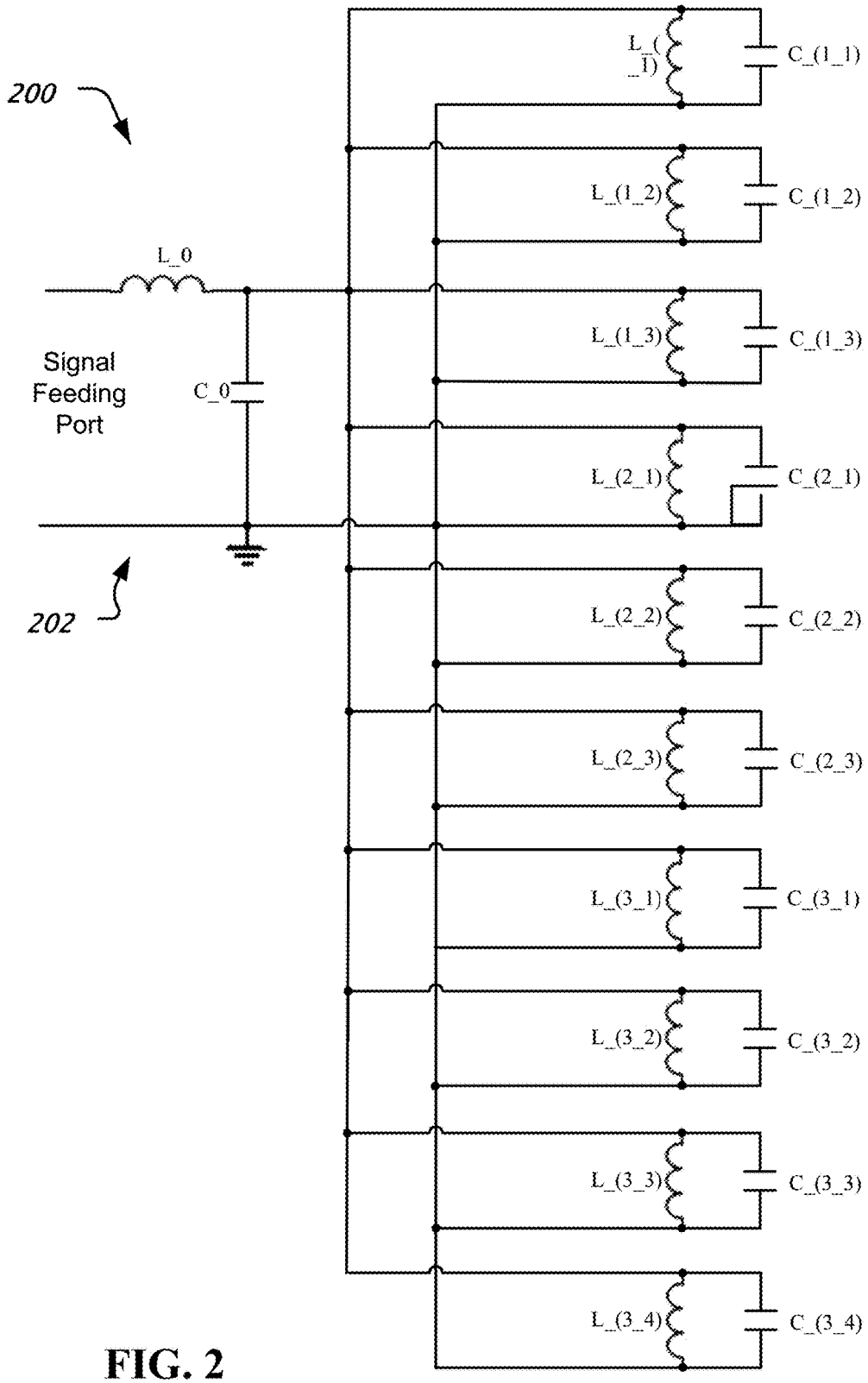
FIG. 2 presents an example equivalent circuit of a multiband folded monopole antenna.

FIG. 2 shows an example equivalent circuit 200 of the multiband microline antenna 100, wherein each of the microline radiation elements is electromagnetically equivalent to a oscillator having a specific resonant frequency, and the resonant frequency.

$$f_(i_j)=1/(2\pi\sqrt{(L_(i_j)C_(i_j))}),\text{ where } i=1,\ 2\ 3;\text{ and } j=1,\ 2,\ 3,\ 4. \qquad \text{Eq. (1).}$$

The resonant frequencies of the microline radiation elements can be slightly different to make the operation bandwidth of the antenna wider enough to cover a desired bandwidth. That is, the resonant frequencies of the radiation elements of f_(1_1), f_(1_2), f_(1_3) are used to cover the operation bandwidth of Band 1, operation at frequencies f_(2_1), f_(2_2), f_(2_3) are used to form the operation bandwidth of Band 2, and operation at frequencies f_(3_1), f_(3_2), f_(3_3), f_(3_4) are used to form the operation bandwidth of Band 3, and so on.

To improve the impedance matching for multiband operation, an impedance matching radio frequency circuit 202 could be added in the feeding line of the multiband microline antenna. The impedance matching radio frequency circuit 202 may comprise of discrete components of capacitors or inductors, or transmission line stubs, or a circuit switch with tunable discrete components.

Figure 3A:
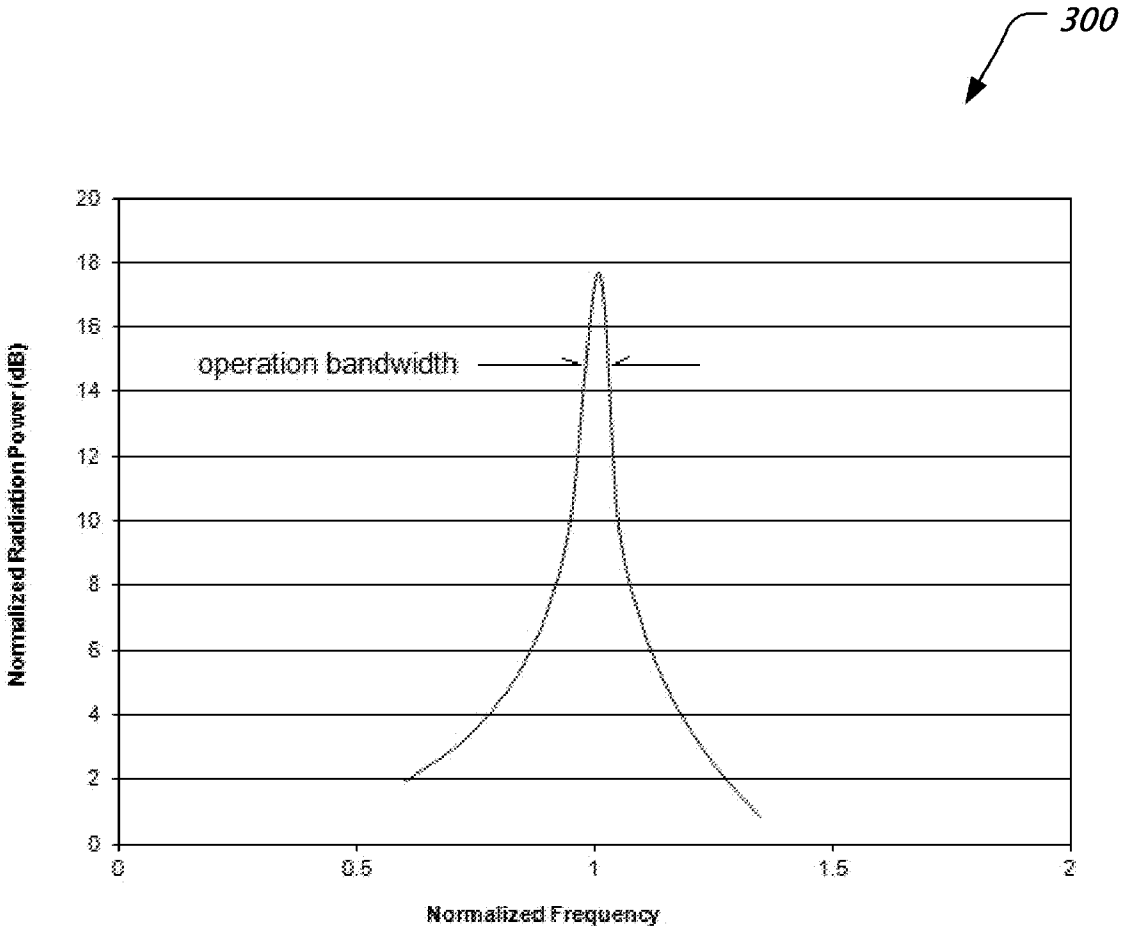
FIG. 3A graphically illustrates an example frequency response of a single radiation element.
Figure 3B:
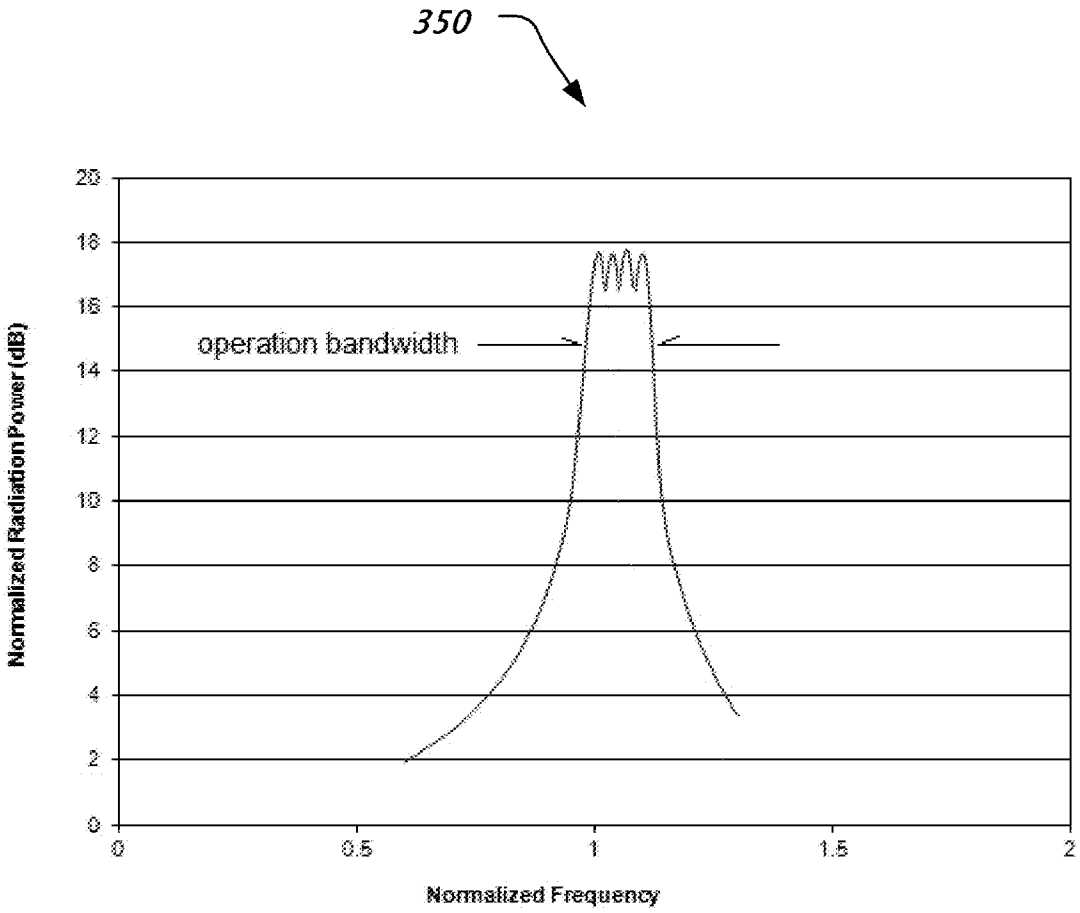
FIG. 3B graphically illustrates an example frequency response of a group of multiple radiation elements.

FIG. 3A graphically illustrates the frequency response of a single microline radiation element (300), and FIG. 3B presents the frequency response 350 of a plurality of microline radiation elements that could be considered as the aggregated effect of a plurality of microline radiation elements in the frequency domain. It is shown the operation bandwidth of a plurality of microline radiation elements is widened based on the different resonant frequencies of the plurality of the microline radiation elements.

Figure 4:
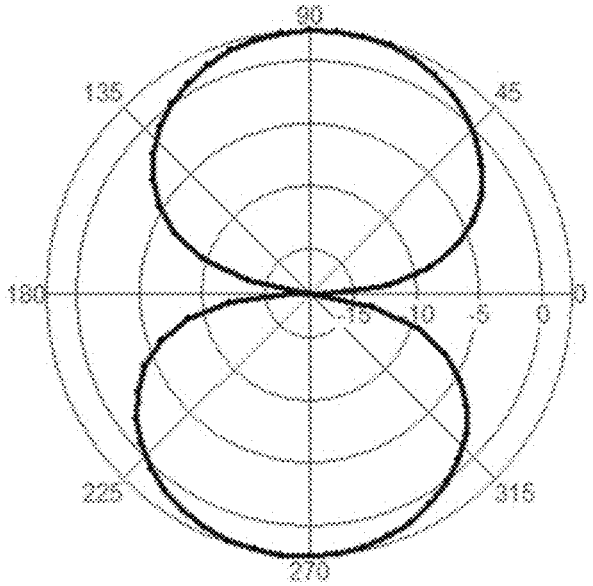
FIG. 4 graphically illustrates an example radiation pattern of a single radiation element.
Figure 4:
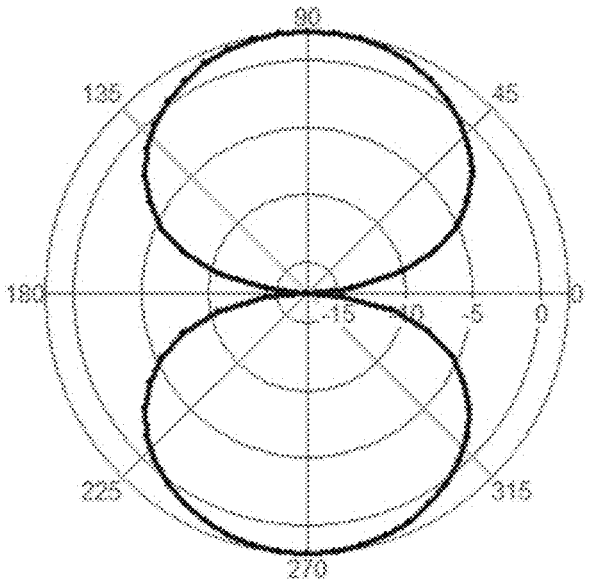

FIG. 4 graphically presents the radiation pattern of a single microline radiation element, operating at the resonant frequency of a single microline radiation element. The graph 400 illustrating the pattern wherein Phi=0° and graph 402 illustrating the pattern wherein Phi=90°. The radiation pattern at a particular operation frequency in the operating frequency band would be similar to that of the single microline radiation element operating at the resonant frequency of the corresponding single microline radiation element.

Figure 5:
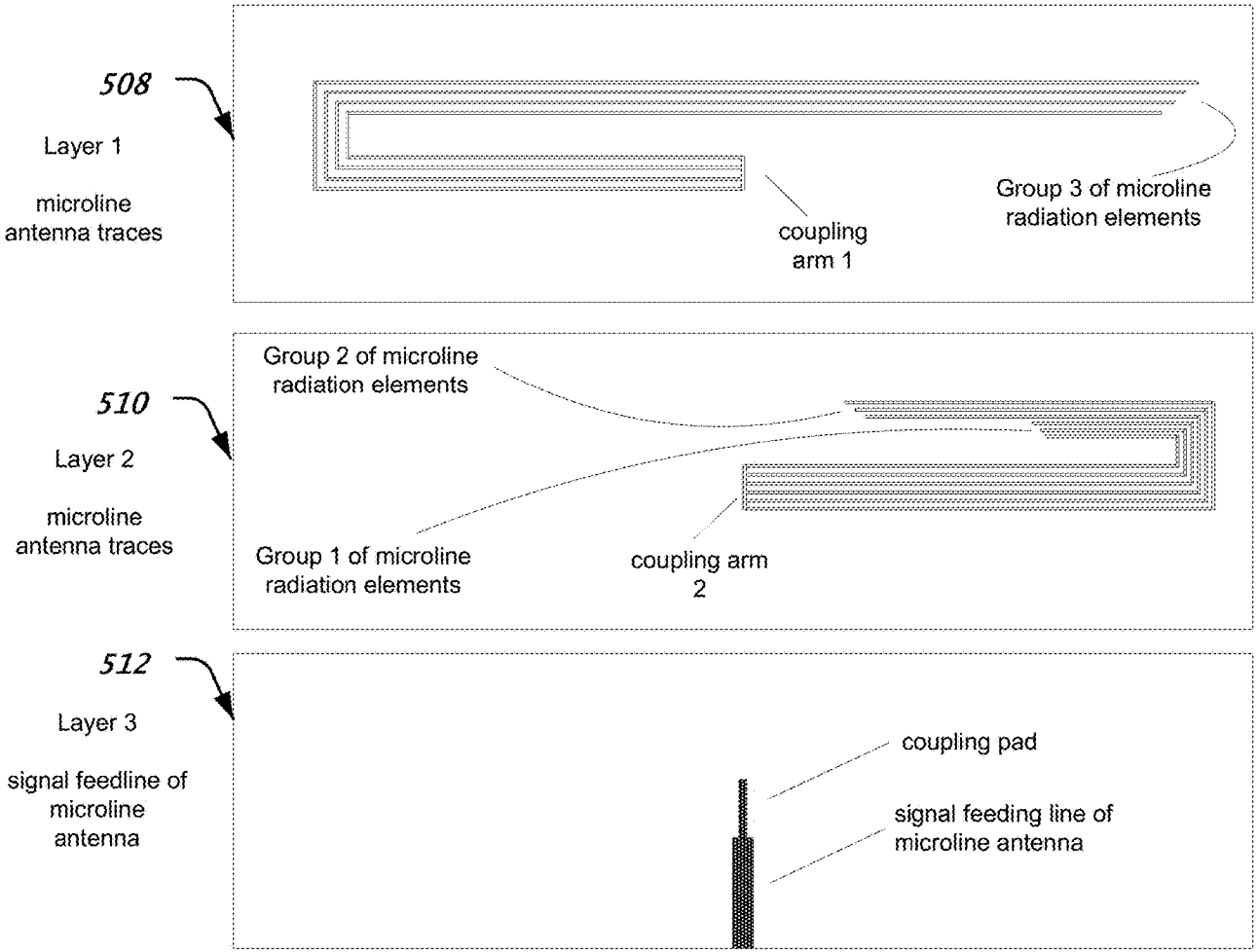
FIG. 5 schematically illustrates an example embodiment of a multiband antenna with feeding scheme of direct coupling.

FIG. 5 schematically illustrates an example embodiment of a multiband microline antenna with feeding scheme of direct coupling. The layered structure of substrates for the embodiment depicted in FIG. 5 may be similar to the substrates and layers depicted in FIG. 1A (e.g., layers 508, 510 and 512 may be similar to layers 108, 110 and 112). The radiation elements may be composed of a plurality of microline radiation elements. Each of the radiation element may be a microline having a width not greater than what a human eye might perceive to be an optical occlusion, e.g., 0.1 millimeter, and a length of a quarter wavelength of the operating frequency. Each of the plurality of the microline radiation elements may be designed to have a slightly different length and the resonant frequency of each of the microline radiation element is slightly different. In this way, the overall operation bandwidth of the plurality of the microline radiation elements can be broadened to have the desired operation bandwidth. As shown in FIG. 5, the group 1 of microline radiation elements may operate in Band 1, the group 2 of microline radiation elements may operate in Band 2, and the group 3 of microline radiation elements operates in may operate in Band 3.

In FIG. 5, the multiband radio frequency signals are electromagnetically coupled to plurality of the microline radiation elements through the coupling pad in the feeding line and the coupling arms in the microline radiation elements. In some of the embodiments, the multiband radio frequency signals could electromagnetically couple to plurality of the microline radiation elements through the coupling pad in the feeding line directly, so that the coupling pad in the signal feeding line also acts as a tuning stub to maximize the signal coupling with the multiband microline antenna.

In FIG. 5, to further extend the operation bandwidth of a particular frequency band, a plurality of microline radiation elements could be added in a multilayered substrate structure, wherein each of the microline radiation elements in Layer 1/2 has a slightly different length from the other microline radiation elements in Layer 1/2.

Also, in FIG. 5, to increase the operating frequency bands, a plurality of microline radiation elements would be further added in a multilayered structure, wherein each of the microline radiation elements in the substrate layer has a different length and resonant frequencies from the other microline radiation elements in Layer 1/2.

The microline elements in a coplanar layer could include branches, wherein each of the branches comprises of a group of microlines and each group of the microlines corresponds to an operating frequency band.

In some embodiments, to improve the impedance matching for multiband operation, an impedance matching radio frequency circuit could be added in the feeding line of the multiband microline antenna. The impedance matching radio frequency circuit may comprise of discrete components of capacitors or inductors, or transmission line stubs, or a circuit switch with tunable discrete components.

Figure 6:
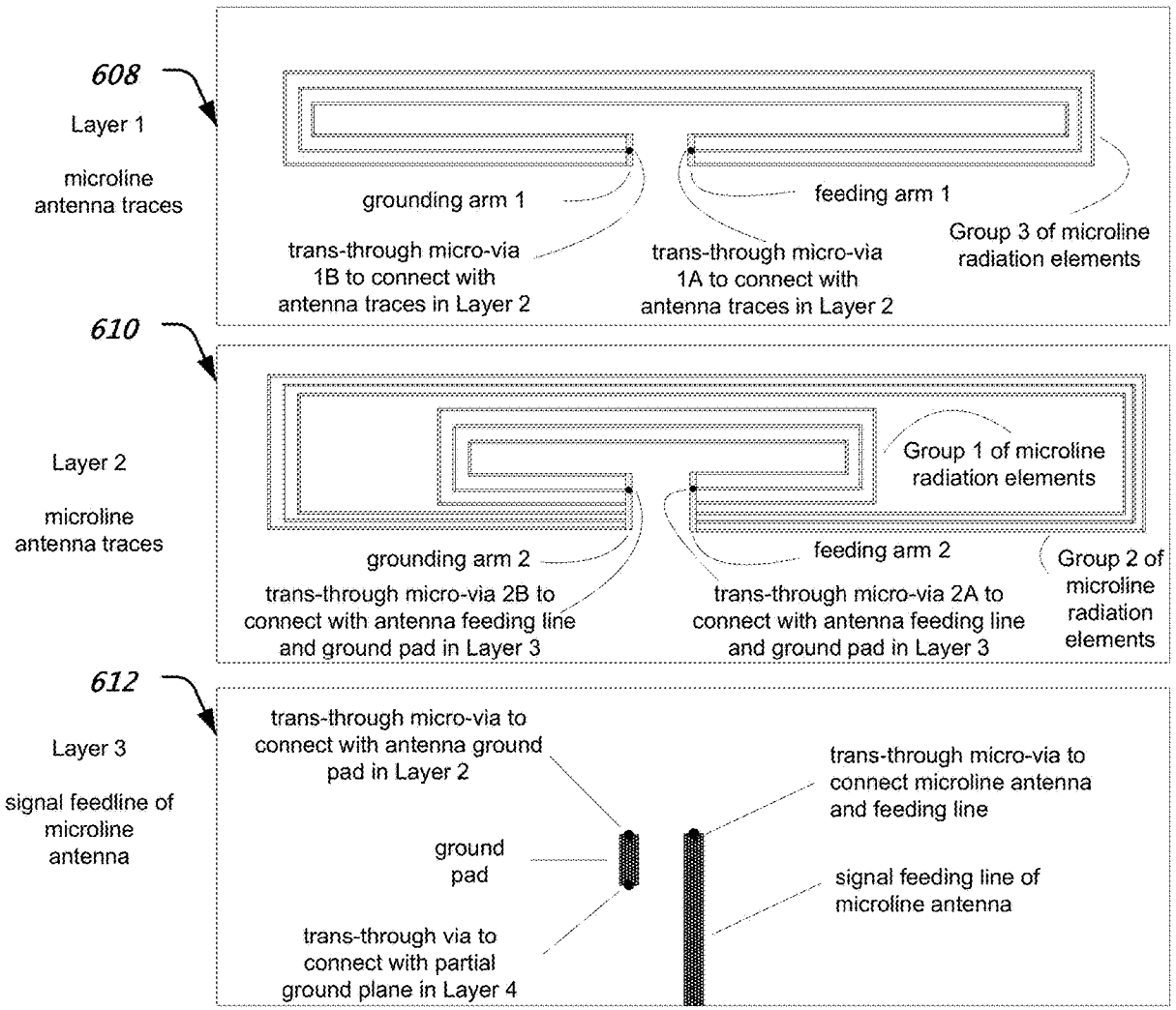
FIG. 6 schematically illustrates an example embodiment of a multiband loop antenna.

FIG. 6 schematically illustrates an example embodiment of a 4-layered multiband microline loop antenna, wherein the radiation elements are composed of microline loops. The layered structure of substrates for the embodiment depicted in FIG. 6 may be similar to the substrates and layers depicted in FIG. 1A (e.g., layers 608, 610 and 612 may be similar to layers 108, 110 and 112). To keep the visual obstruction by the microline loop to a minimum, each of the microline loops may have a width not greater than 0.1 millimeter. Each microline loop may have a length of one wavelength of the operation frequency. The microline loops may each have a slightly different length and the operation frequency of each of the microline radiation element may be slightly different (e.g., different by 1 to 10 MHz). Similar to the scenario as illustrated in FIG. 3, the overall accumulated operation bandwidth of the plurality of the microline loops can thus be extended to have the desired operation bandwidth.

In FIG. 6, the signal feeding line is placed in Layer 3, while the ground plane is placed in Layer 4 which has partial ground metallic plane of the antenna. Also in Layer 3, there is a metallic ground pad that electrically connects with the ground plane in Layer 4 through a trans-through micro-via with a filling of conductive material. A plurality of microline loops operating at frequency bands Band 1 and Band 2 are placed in Layer 2, and a plurality of microline loops operating at frequency band Band 3 are located in Layer 2. The plurality of the microline loops in Layer 2 are electrically connected in the feeding portion at the end of the radiation elements, and a trans-through micro-via with a filling of conductive material is placed between Layer 2 and Layer 3 to electrically connected the feeding signal and the feeding portion of the these microline loops in Layer 2. Also the plurality of the microline loops in Layer 2 are electrically connected in the other end of the radiation elements, and a trans-through micro-via with a filling of conductive material is placed between Layer 2 and Layer 3 to electrically connected the microline loops with the ground pad in Layer 3. Furthermore, the plurality of the microline loops in Layer 1 are electrically connected in the feeding portion at the end of the radiation elements, and a trans-through stacked micro-via with a filling of conductive material is placed through Layer 1, Layer 2, and Layer 3 to electrically connected the feeding signal and the feeding portion of these microline loops in Layer 1. Also the plurality of the microline loops in Layer 1 are electrically connected in the other end of the radiation elements, and a trans-through stacked micro-via with a filling of conductive material is placed through Layer 1, 2 and 3 to electrically connected the microline loops with the ground pad in Layer 3.

To improve the impedance matching for multiband operation, an impedance matching radio frequency circuit could be included in the signal feeding line of the microline antenna depicted in FIG. 6. The impedance matching radio frequency circuit may comprise discrete components of capacitors or inductors, or transmission line stubs, or a circuit switch with tunable discrete components. As well, to make the operation band adjustable, the ground pad could be loaded with a tunable capacitor, or a single-pole-multiple-throw (SPxT) switch loaded with capacitors of different values so that the resonant frequency of each radiation elements are tunable.

Although two substrates are illustrated in FIG. 6, more substrates could be used for multiband operation or the operation bandwidth extension, wherein the each of the substrates includes a plurality of conductive microline radiation elements and are electromagnetically coupled to the signal feeding trace through the stacked micro-via with a filling of conductive material across the multilayered substrates.

In some embodiments, the microline loop elements in a coplanar layer could include branches to form different loops and operate at different frequency bands, wherein each of the branches comprises of a group of microline loops and each group of the microlines corresponds to an operating frequency band.

Figure 7:
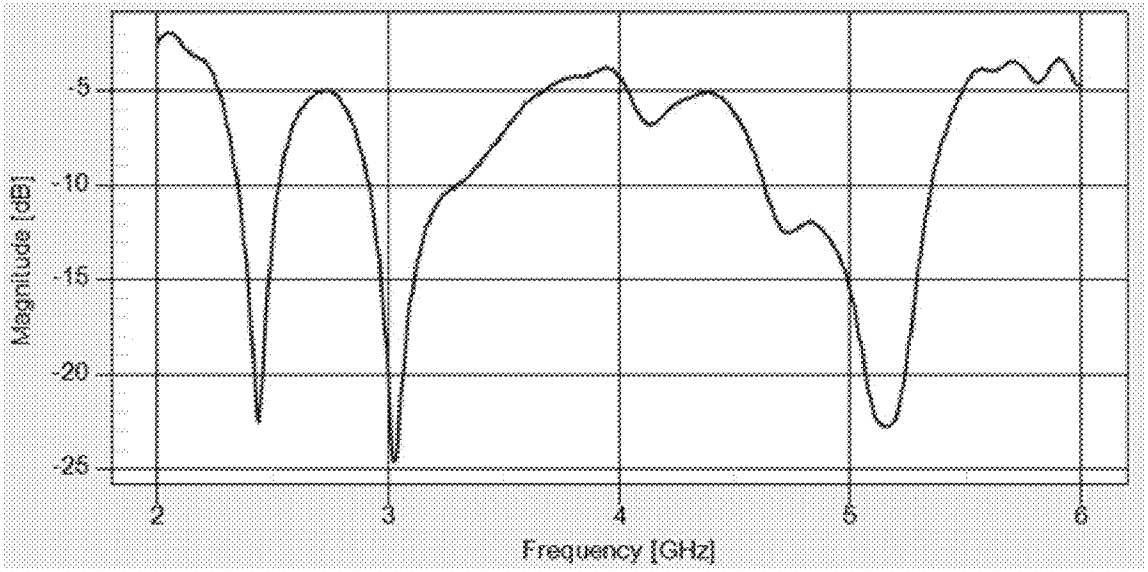
FIG. 7 is a graphical example of the frequency response of a multiband microline loop antenna.

FIG. 7 graphically depicts an example frequency response 700 of a multiband microline loop antenna, wherein a tri-band frequency operation performance is shown. In FIG. 7, each of the operation band is generated by a group of radiation elements of microline loops, as illustrated in FIG. 6.

Figure 8:
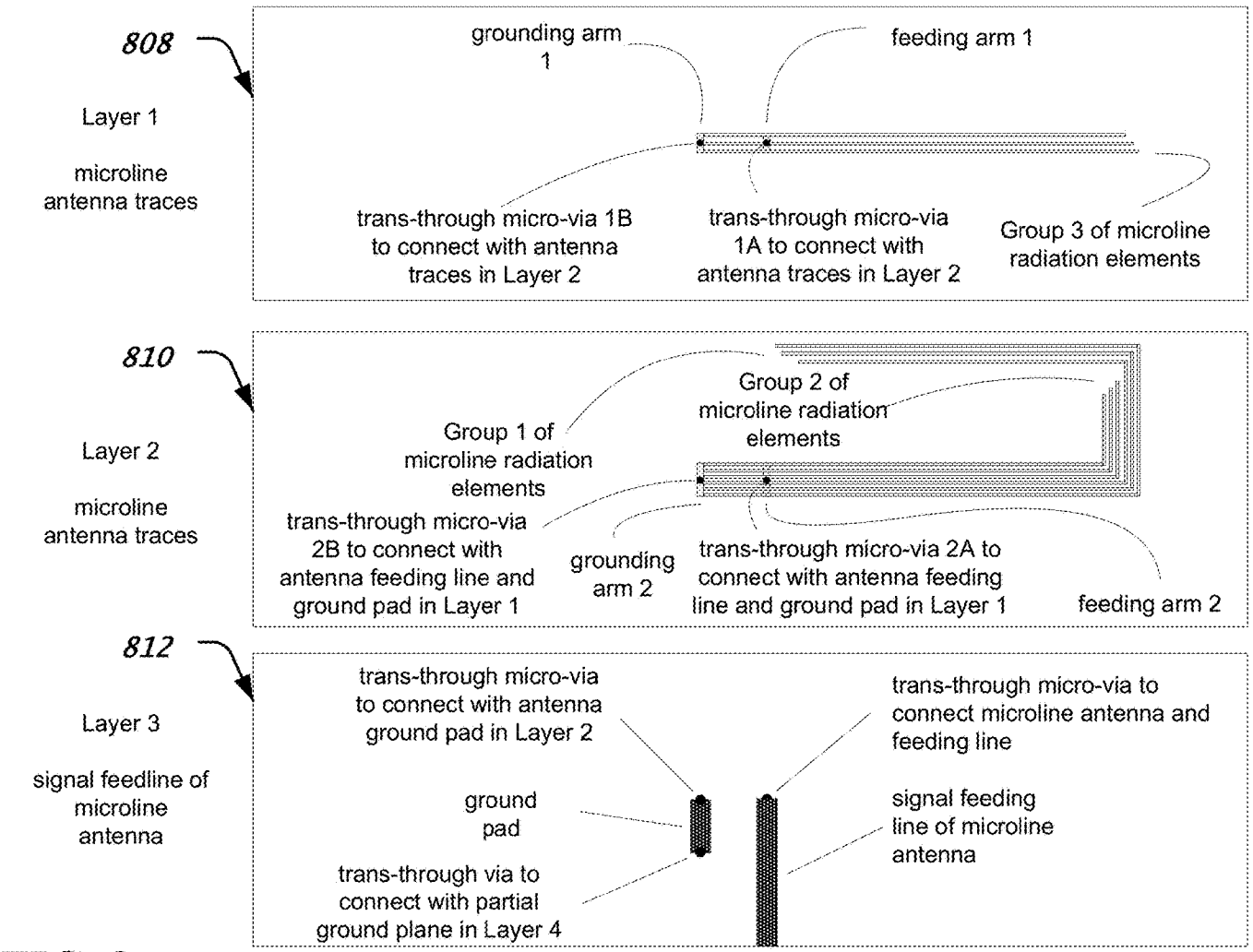
FIG. 8 schematically illustrates an example embodiment of a multiband inverted-F antenna.

FIG. 8 schematically illustrates an example embodiment of a four-layered multiband microline inverted-F antenna, wherein the radiation elements are composed of a plurality of radiation elements of microlines that have common feeding arm and common grounding arm. The layered structure of substrates for the embodiment depicted in FIG. 8 may be similar to the substrates and layers depicted in FIG. 1A (e.g., layers 808, 810 and 812 may be similar to layers 108, 110 and 112). To minimize visual occlusion, each of the microlines has a width not greater than 0.1 millimeter, and a length of a quarter of wavelength of the operation frequency. Each radiation elements of the plurality of the microlines have slightly different length and the operation frequency of each of the microline radiation element is slightly different (e.g., 1 to 10 MHz). Similar to the scenario as illustrated in FIG. 3B, the overall operation bandwidth of the plurality of the microline radiation elements are extended to have the desired operation bandwidth.

In FIG. 8, the signal feeding line trace is placed in Layer 3, while the ground plane is placed in Layer 4 which has partial ground metallic plane of the antenna. Also in Layer 3, there is a metallic ground pad that electrically connects with the ground plane in Layer 4 through a trans-through micro-via with a filling of conductive material. A plurality of microline radiation elements operating at frequency bands Band 1 and Band 2 are placed in Layer 2, and a plurality of microline radiation elements operating at frequency band Band 3 are located in Layer 1. The plurality of the microline radiation elements in Layer 2 are electrically connected in the common feeding arm 2 of the radiation elements, and a trans-through micro-via with a filling of conductive material is placed between Layer 2 and Layer 3 to electrically connected the feeding signal and the feeding arm 2 of the microline radiation elements. Also the plurality of the microlines in Layer 2 are electrically connected in the grounding arm 2 of the radiation elements, and a trans-through micro-via with a filling of conductive material is placed between Layer 2 and Layer 3 to electrically connected the microlines with the ground pad in Layer 3. Furthermore, the plurality of the microlines in Layer 1 are electrically connected in the feeding arm 1 of the radiation elements, and a stacked trans-through micro-via with a filling of conductive material is placed through Layer 1, Layer 2, and Layer 3 to electrically connected the feeding signal and the feeding arm 1 of the microlines. Also the plurality of the microlines in Layer 1 are electrically connected in the ground arm 1 of the radiation elements, and a stacked trans-through micro-via with a filling of conductive material is placed through Layer 1, 2 and 3 to electrically connected the microline radiation elements with the ground pad in Layer 3.

In FIG. 8, to improve the impedance matching for multiband operation, impedance matching radio frequency circuit could be added in the feeding line of the microline antenna. The impedance matching radio frequency circuit may comprise of discrete components of capacitors or inductors, or transmission line stubs, or a circuit switch with tunable discrete components. As well, to make the operation band adjustable, the ground pad could be loaded with a tunable capacitor, or a single-pole-multiple-throw (SPxT) switch loaded with capacitors of different values so that the resonant frequency of each radiation elements are adjustable.

Although two substrates are illustrated in FIG. 8, it is noted more substrates could be used for multiband operation or operation bandwidth extension, wherein the each of the substrates includes a plurality of conductive microline radiation elements and are electromagnetically coupled to the signal feeding line and the ground through stacked micro-vias with a filling of conductive material.

Figure 9:
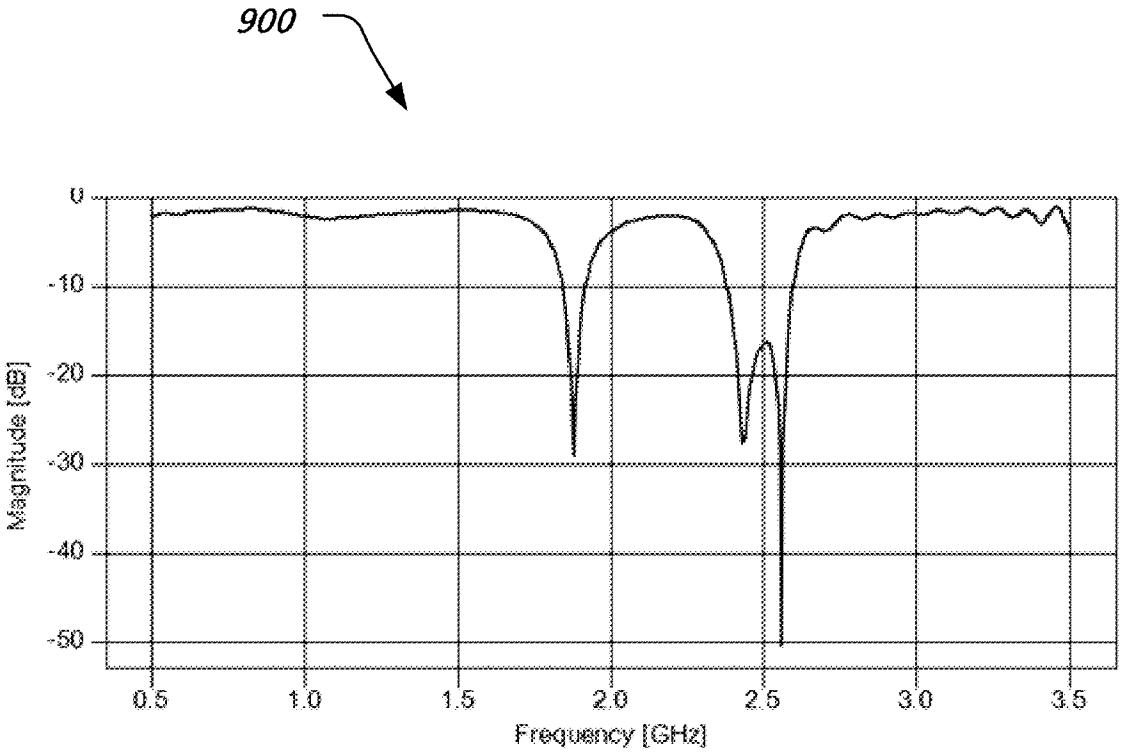
FIG. 9 depicts an example of the frequency response of a multiband microline inverted-F antenna.

FIG. 9 shows an example frequency response 900 of a multiband inverted-F antenna, e.g., as depicted in FIG. 8, wherein a tri-band operation performance is shown. In FIG. 9, each of the operation band is generated by a group of radiation elements of microlines, as illustrated in group 1, group 2 and group 3 of FIG. 8.

Figure 10:
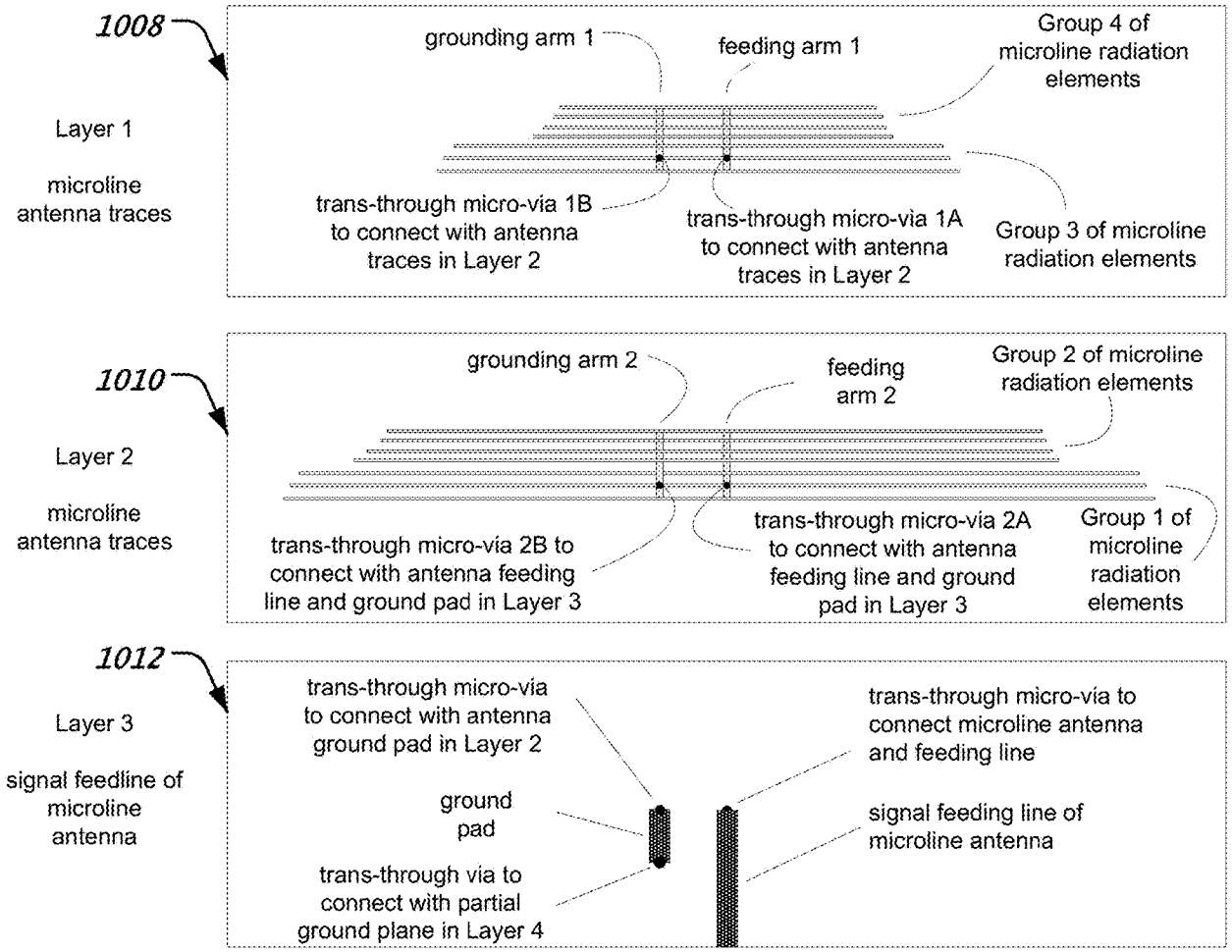
FIG. 10 schematically illustrates an example embodiment of a multiband microline π-shaped antenna.

FIG. 10 schematically illustrates an example embodiment of a four-layered multiband microline π-shaped antenna, wherein the radiation elements are composed of a plurality of radiation elements of microlines that have a common feeding portion and a common grounding portion, and each of the microlines has a width not greater than 0.1 millimeter. The layered structure of substrates for the embodiment depicted in FIG. 10 may be similar to the substrates and layers depicted in FIG. 1A (e.g., layers 1008, 1010 and 1012 may be similar to layers 108, 110 and 112). The plurality of the microlines have slightly different lengths and the operation frequency of each of the microline radiation element is minor different. Similar to the scenario as illustrated in FIG. 3B, the overall operation bandwidth of the plurality of the microline radiation elements are improved to have the desired operation bandwidth.

In FIG. 10, the signal feeding line trace is placed in Layer 3, while the ground plane is placed in Layer 4 which has partial ground metallic plane of the antenna. Also in Layer 3, there is a metallic ground pad that electrically connects with the ground plane in Layer 4 through a trans-through micro-via with a filling of conductive material. A plurality of microline radiation elements operating at frequency band 1 and band 2 are placed in Layer 2, and a plurality of microline radiation elements operating at frequency band 3 and band 4 are located in Layer 1. The plurality of the microline radiation elements in Layer 2 are electrically connected in the common feeding arm 2 of the radiation elements, and a trans-through micro-via with a filling of conductive material is placed between Layer 2 and Layer 3 to electrically connected the feeding signal and the feeding arm 2 of the microline radiation elements. Also the plurality of the microlines in Layer 2 are electrically connected in the grounding arm 2 of the radiation elements, and a trans-through micro-via with a filling of conductive material is placed between Layer 2 and Layer 3 to electrically connected the microlines with the ground pad in Layer 3. Furthermore, the plurality of the microlines in Layer 1 are electrically connected in the feeding arm 1 of the radiation elements, and a stacked trans-through micro-via with a filling of conductive material is placed through Layer 1, Layer 2, and Layer 3 to electrically connected the feeding signal and the feeding arm 1 of the microlines. Also the plurality of the microlines in Layer 1 are electrically connected in the grounding arm 1 of the radiation elements, and a stacked trans-through micro-via with a filling of conductive material is placed through Layer 1, 2 and 3 to electrically connected the microline radiation elements with the ground pad in Layer 3.

Although two substrates are illustrated in FIG. 10, it is noted more substrates could be used for multiband operation and/or operation bandwidth extension, where the each of the substrates includes a plurality of conductive microline radiation elements and are electromagnetically coupled to the signal feeding trace through the stacked micro-vias with a filling of conductive material.

In FIG. 10, to improve the impedance matching for multiband operation, impedance matching radio frequency circuit could be added in the feeding line of the microline antenna. The impedance matching radio frequency circuit may comprise of discrete components of capacitors or inductors, or transmission line stubs, or a circuit switch with tunable discrete components. As well, to make the operation band adjustable, the ground pad could be loaded with a tunable capacitor, or a single-pole-multiple-throw (SPxT) switch loaded with capacitors of different values so that the resonant frequency of each radiation elements are adjustable.

Figure 11:
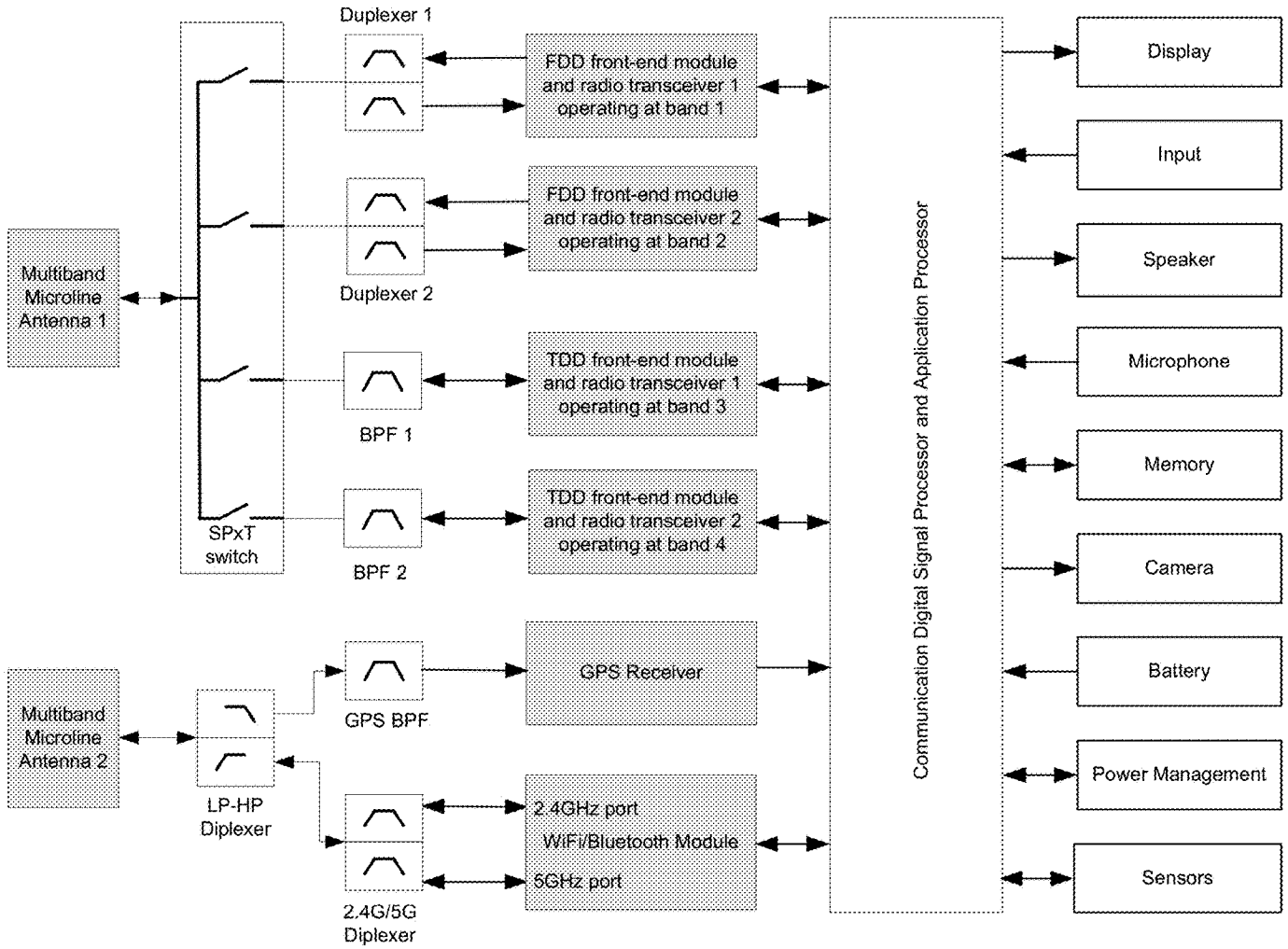
FIG. 11 shows an example block diagram of a mobile wireless device that supports multiband multimode radio communication protocol.

FIG. 11 illustrates an example application of the multiband microline antenna in a mobile wireless device that supports multiband multimode radio communication protocol. The core component of the mobile wireless device is the communication digital signal processor and the application processor, and include at least display, user input component (such as keyboard, or touch screen), speaker, microphone, memory, camera, battery, power management, sensors, multiple radio transmitter and receiver (transceiver) to support multiple radio communication protocols, and the multiband microline antenna as disclosed in this invention. In FIG. 11, multiband microline antenna 1 is used to transmit and receive multiband radio signal of cellular communication that include but are not limited to GSM, CDMA, WCDMA, TD-SCDMA, LTE TDD, LTE FDD protocols. The multiband microline antenna 1 connects with a single-pole-multiple-throw (SPxT) switch, and each throw port of the switch is electrically connected either with a duplexer and a FDD transceiver or a bandpass filter (BPF) and a TDD transceiver. And each of the radio transceiver connects with the communication digital signal processor and the application processor. Also, a multiband microline antenna 2 is used to support GPS, Bluetooth, and 2.4 GHz and 5 GHz Wi-Fi operation. The multiband microline antenna 2 is electrically connected with a lowpass (LP) and highpass (HP) diplexer: the LP port of the diplexer connects the a BPF of GPS band and the GPS receiver, and the HP port connects the a 2.4 GHz/5 GHz diplexer and the Wi-Fi/Bluetooth module. The GPS receiver and the Wi-Fi/Bluetooth module are then connected the communication digital signal processor and the application processor.

In FIG. 11, the multiband microline antenna not only have the multiband radio operation capability, but also improve the transparency when the housing and the substrates of the antenna portion of the mobile wireless device are transparent or translucent.

Figure 12:
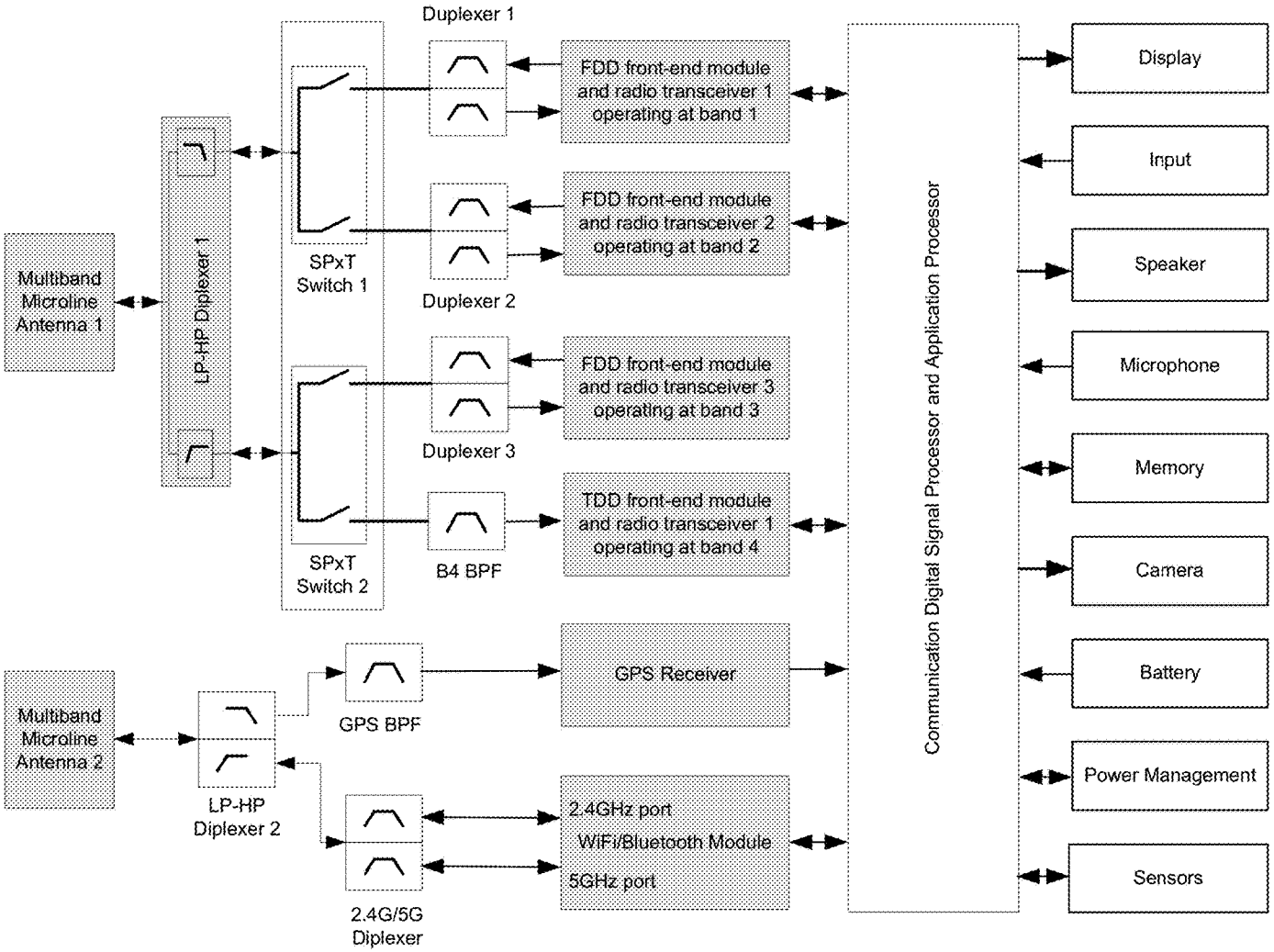
FIG. 12 shows an example block diagram of a mobile wireless device that supports multiband multimode radio communication protocol and can perform carrier aggregation.

FIG. 12 illustrates an example application of the multiband microline antenna in a mobile wireless device that supports multiband multimode radio communication protocol and has the capability of carrier aggregation. In FIG. 12, multiband microline antenna 1 is used to transmit and receive multiband radio signal of cellular communication that include but are not limited to GSM, CDMA, WCDMA, TD-SCDMA, LTE TDD, LTE FDD protocols. Also, a multiband microline antenna 2 is used to support GPS, Bluetooth, and 2.4 GHz and 5 GHz Wi-Fi operation. As compared with FIG. 11, it is seen a low-pass high pass (LP-HP) diplexer 1 and two SPxT switches 1 and 2 are used to accommodate the inter-band carrier aggregation for uplink transmission and downlink signal reception. The multiband microline antennas in FIG. 12 not only have the multiband radio operation capability, but also improve the transparency when the housing and the substrates of the antenna portion of the mobile wireless device are transparent or translucent.

Figure 13:
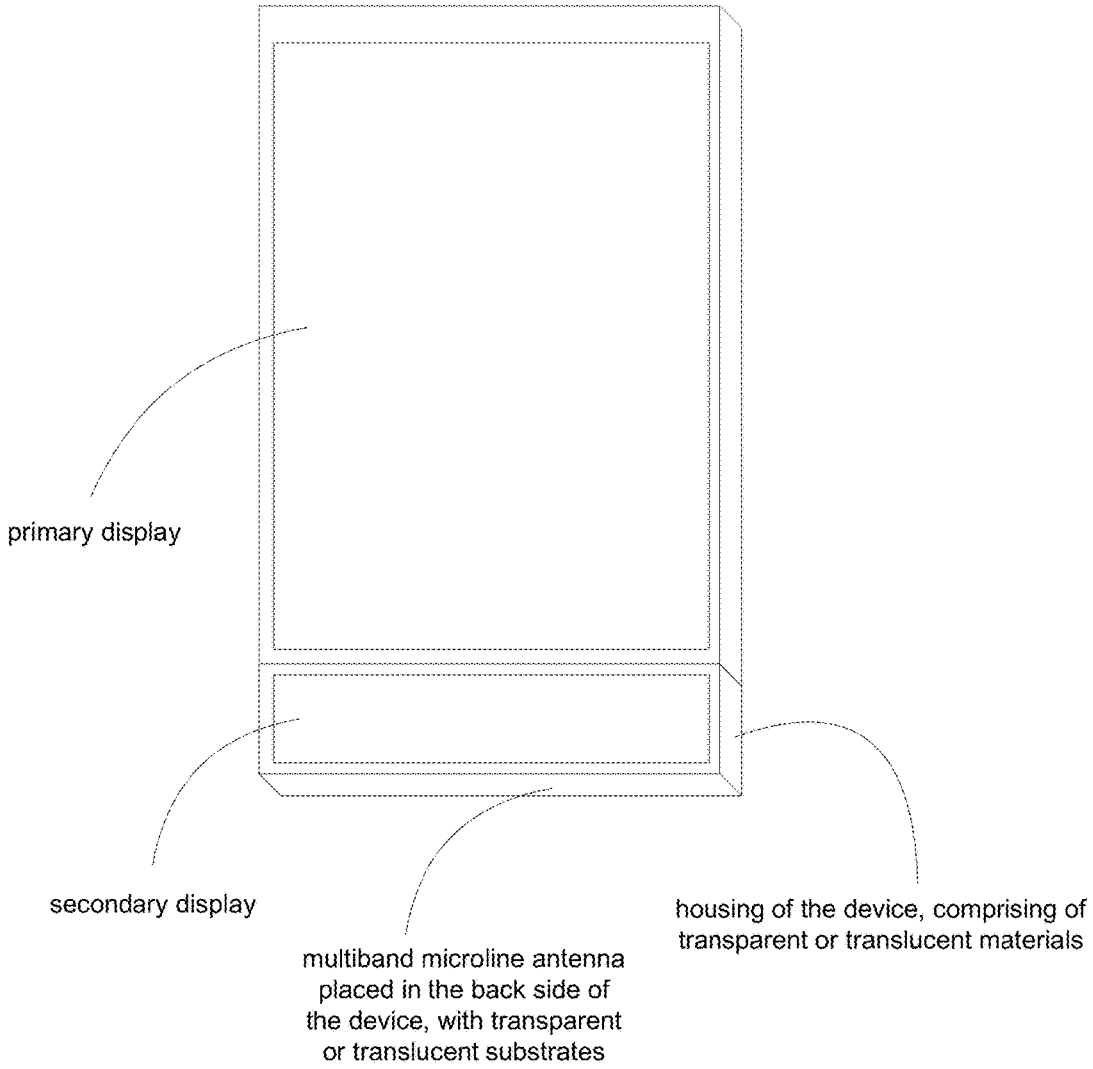
FIG. 13 illustrates an example application of the multiband microline antenna in a mobile wireless device that has a small secondary display in the bottom portion of the device with visual transparency, where the multiband microline antenna is place on the back side of the bottom portion of the device.

FIG. 13 illustrates an example application of the multiband microline antenna in a mobile wireless device that has a small secondary display in the bottom portion of the device with visual transparency. The back side of the secondary display includes the multiband microline antenna wherein the base substrate and substrates of the multiband microline antenna comprise of transparent or translucent materials, e.g., glass. The secondary display could be configured to display virtual keys, time, short message, calendar reminder, phone number of incoming call, etc., when the primary display is turned off to extend the battery life of the device. Alternatively, the secondary display could be configured to display contents while the primary display is used for priority task, e.g., writing message, playing game. Attributing its visual transparency, the secondary display would display contents on both sides of the device, and may bring better user experience of the device.

Figure 14:
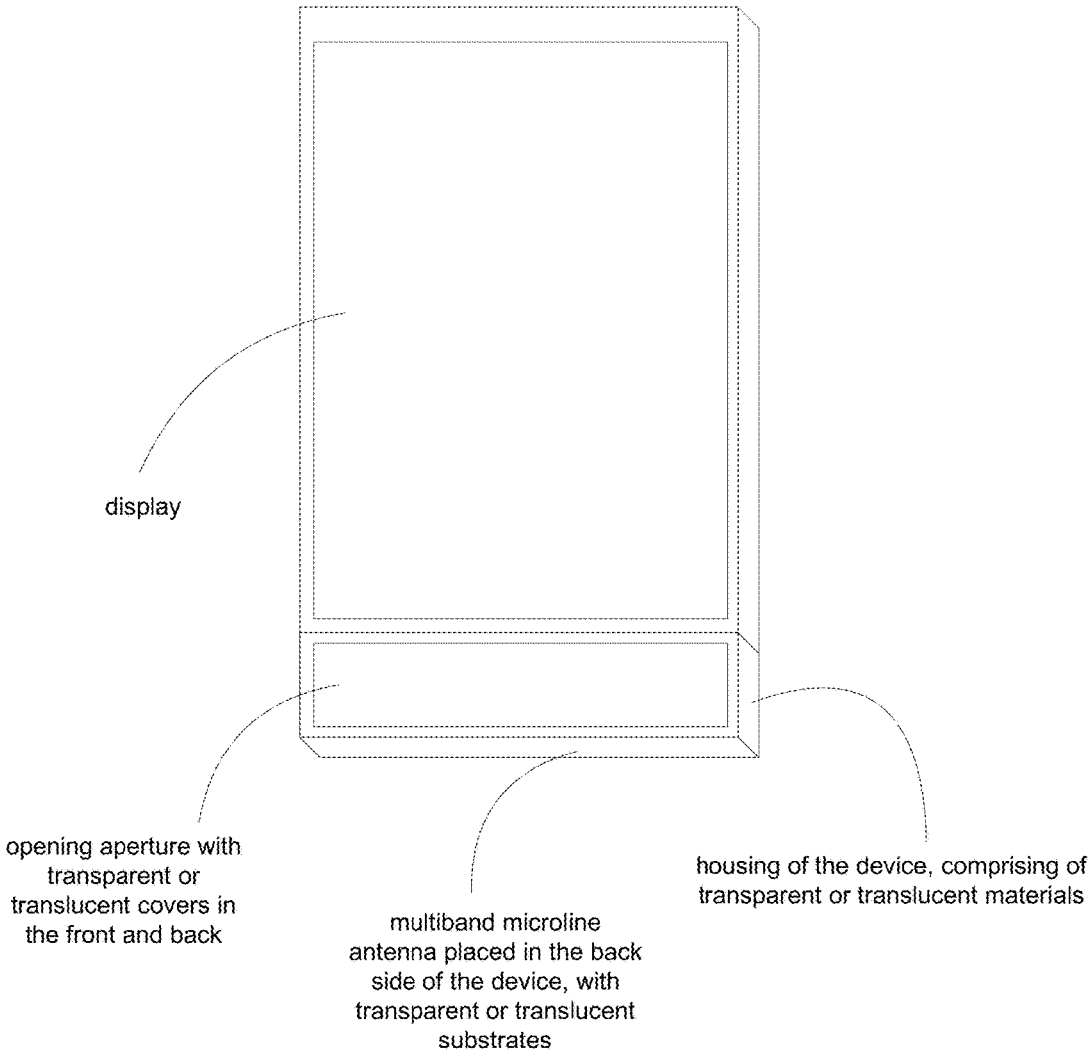
FIG. 14 illustrates an example application of the multiband microline antenna in a mobile wireless device that has a small opening in the bottom portion of the device with visual transparency, where the multiband microline antenna is place on the back side of the bottom portion of the device.

FIG. 14 illustrates an example applications of the multiband microline antenna in a mobile wireless device that has a small opening aperture in the bottom portion of the device with visual transparency, while the other portion of the back side of the device comprises of metal or any other opaque materials, or a type of transparent or translucent materials. The back side of the small opening aperture includes the multiband microline antenna wherein the base substrate and substrates of the multiband microline antenna comprise of transparent or translucent materials. The housing of the device comprises of transparent or translucent material at least in the bottom portion of the device, wherein the small opening aperture has transparent or translucent cover layers in the front and back. Inside the small opening aperture, at least one of the light-based sensors may be included. These light-based sensor could include a light-based proximity detection sensor, light-based ranging sensor, ambient light sensor, luminance sensor, color sensor. The light-based sensor detects the light-based information and these information are converted into electrical signals and transmitted to the central processor of the device. Based on the received light-based information, the processor could be configured to have real-time application. Attributing its visual transparency, the light-based sensor in the opening aperture may bring better user experience and applications of the device.

Additionally, in FIG. 14, the small opening aperture could include embedded light-emitting diode (LED) to transmit visible light, or ultraviolet light, or infrared light. Here, the LED light could be commanded by the processor of the device and could be configured to be controlled by the user or as a media for communication in light spectrum.

Here is an application example of the device as illustrated in FIG. 14. The small opening aperture has the transparent or translucent covers in both side of the aperture wherein the multiband microline antenna is located in the back side of the aperture cover. A electronic circuit in placed inside the aperture that includes an embedded light-based proximity detection sensor and an array of LEDs wherein each of the LED could emit different color of the light attributing to the semiconductor material difference. Depending on the information the light-based proximity detection sensor sensed, the LEDs could be configured to emit different color of light.

Furthermore, since the small transparent or translucent opening in the bottom portion of the device could embed light-based sensor and LED-based light emission photodiodes, it could be used in a touch-sensing screen to detect reflected light from fingers as an user authentication or authorization method.

The multiband microline antenna, as disclosed in this invention, can also be used as the secondary antenna for multiple-in-multiple-out (MIMO) and/or frequency diversity and/or space diversity application in a mobile wireless device.

In some embodiments, an antenna subsystem for use in a wireless receiver includes at least three substrate layers: a first substrate, a second substrate that is positioned under the first substrate, and a base substrate that is positioned under the second substrate. A first layer is on top of the first substrate and has a first plurality of antenna elements on the first layer. A second layer, which corresponds to the planar region between the first substrate and the second substrate, has a second plurality of radiation elements. A signal feeding line on the third layer is electrical coupled to the first plurality of radiation elements and the second plurality of radiation elements. A partial ground plane is positioned on the underside of the base substrate.

For example, the substrates and layers of the antenna subsystem may be arranged as shown in FIG. 1A, FIG. 5, FIG. 6, FIG. 8 and FIG. 10. The radiation elements may be, e.g., conductive strips etched or fabricated on the corresponding substrate layer. The conductive strips may be microline, e.g., relatively thin width and long conductive lines.

In some embodiments, each radiation element from the first plurality of radiation elements has a width not greater than 0.2 millimeter (mm). Alternatively or additionally, each radiation element from the second plurality of radiation elements may have a width not greater than 0.1 mm. Advantageously, the small width may minimize or eliminate visual obstruction caused by the presence of the radiation elements on or near a screen on which user interface is rendered in the wireless device.

In some embodiments, at least some of the first plurality of radiation elements have lengths different from each other. In some embodiments, each radiation element may have different length. By having different lengths of radiation elements, diversity of frequency domain characteristics of the radiation pattern may be obtained, thus providing a desired frequency domain shape to the antenna beam for transmission or reception.

In some embodiments, at least some of the first plurality of radiation elements have differing resonant frequencies. Alternatively, or additionally, in some embodiments, at least some of the second plurality of radiation elements have differing resonant frequencies In some embodiments, multi band operation of the antenna subsystem may be achieved by having the first plurality of radiation elements have resonant frequencies in a first frequency band, and the second plurality of radiation elements have resonant frequencies in a second frequency band that is different from the first frequency band. For example, in a multiband operation, the same antenna hardware could be used to receive or send data at different frequencies or using different communication standards (e.g., Wi-Fi or LTE, or WiMax) by sharing the antennas in time domain.

In some embodiments, the first plurality of radiation elements are electrically coupled to a first common connected feeding arm, and the second plurality of radiation elements are electrically coupled to a second common connected feeding arm.

In some embodiments, the signal feeding line is electrically coupled with the first common connected feeding arm through a first trans-through micro-via and the second common connected feeding arm through a second trans-through micro-via. FIG. 1, FIG. 6, FIG. 8 and FIG. 10 depict some example embodiments of the antenna subsystem where the coupling achieved by using trans-through micro-via.

In some embodiments, the first trans-through micro-via and the second trans-through micro-via each has a diameter of not greater than 0.1 millimeter and is filled with a conductive material.

In some embodiments, the first plurality of radiation elements are electrically connected to a first common coupling arm, the second plurality of radiation elements are electrically connected to a second common coupling arm, and the signal feeding line includes a coupling pad at an end to electromagnetically couple the signal feeding line to the first plurality of radiation elements and the second plurality of radiation elements. FIG. 5 depicts some example embodiments.

In some embodiments, a first common grounding arm electrically connects the first plurality of radiation elements to the partial ground plane through a first trans-through micro-via between the first substrate layer and the base substrate layer, and a second common grounding arm electrically connects the second plurality of radiation elements to the partial ground plane through a second trans-through micro-via between the second substrate layer and the base substrate layer. FIG. 6, FIG. 8 and FIG. 10 depict some example embodiments.

In some embodiments, the first trans-through micro-via and the second trans-through via each has a diameter no greater than 0.1 millimeter and is filled with a conductive material.

In some embodiments, at least one of the plurality of the first radiation elements is a folded monopole having a length equal to a quarter of wavelength of an operational frequency, and radiation elements from the first plurality of the radiation elements have passbands with a plurality of different operational frequencies to cover a desired operational frequency bandwidth. Alternatively, or additionally, in some embodiments, at least one of the plurality of the second radiation elements is a folded monopole having a length equal to a quarter of wavelength of an operational frequency, and radiation elements from the second plurality of the radiation elements have passbands with a plurality of different operational frequencies to cover a desired operational frequency bandwidth.

In some embodiments, at least one of the first plurality of the radiation elements is a conductive loop having a length equal to a wavelength of an operational frequency. Further, radiation elements from the first plurality of the radiation elements may have different resonant frequencies that are staggered to cover a desired operational frequency bandwidth. Alternatively, or additionally, in some embodiments, at least one of the second plurality of the radiation elements is a conductive loop having a length equal to a wavelength of an operational frequency. Further, radiation elements from the second plurality of the radiation elements may have different resonant frequencies that are staggered to cover a desired operational frequency bandwidth.

In some embodiments, the conductive loop is electrically connected to a common feeding arm at one end and a common grounding arm at another end, and the common feeding arm is electrically connected to the signal feeding line and the common grounding arm is electrically connected to the partial ground plane. FIG. 6, FIG. 8 and FIG. 10 depict some example embodiments.

In some embodiments, at least one of the first plurality of radiation elements, and/or the second plurality of radiation elements, is an inverted-F antenna having a length equal to a quarter of wavelength of an operational frequency, and radiation elements from the first plurality of the radiation elements have different resonant frequencies that are staggered to cover a desired operational frequency bandwidth.

In some embodiments, the inverted-F radiation element is electrically connected to a common feeding arm at one end and a common grounding arm at another end, and the common feeding arm is electrically connected to the signal feeding line and the common grounding arm is electrically connected to the partial ground plane by a trans-through micro-via between the first substrate layer and the base substrate layer.

In some embodiments, each of the first plurality of radiation elements and the second plurality of radiation elements is an inverted-F radiation element having a unique operational frequency to provide a multi-band operational frequency coverage by the antenna apparatus.

In some embodiments, each of the first plurality of radiation elements, and/or the second plurality of radiation elements, is a $\pi$-shaped element having a unique length and resonant frequency, in order to cover a desired operational frequency bandwidth by combination of the resonant frequencies of the first plurality of radiation elements.

In some embodiments, the first plurality of radiation elements, and/or the second plurality of radiation elements, is electrically connected to a common feeding arm at one end and a common grounding arm at another end, and the common feeding arm is electrically connected to the signal feeding line and the common grounding arm is electrically connected to the partial ground plane by a trans-through micro-via between the first substrate, and/or the second substrate and the base substrate.

In some embodiments, the desired operational frequency bandwidth comprises multiple frequency bands of operation which may be non-overlapping and disjoint from each other in the frequency domain.

In some embodiments, the antenna system may include an impedance matching radio frequency circuit that provides frequency-dependent impedance matching for the multiband operation of the antenna apparatus.

In some embodiments, the impedance matching radio frequency circuit comprises one of a circuit with discrete capacitors or inductors, a circuit with transmission line stubs, and a circuit switch with tuneable discrete components.

In some embodiments, the antenna system may further include a frequency tuneable circuit to make an operational band of the antenna apparatus adjustable, and the frequency tuneable circuit comprises one of a tuneable capacitor and a single-pole-multiple-throw (SPxT) switch loaded with capacitors of different values.

While two antenna element groups are generally depicted in FIGS. 5, 6, 8 and 10 for ease of explanation, in some embodiments, the antenna system may further include additional antenna substrate layers positioned on top of the first substrate layer. Each additional antenna substrate layers may include a plurality of conductive radiation elements and are electromagnetically coupled to the signal feeding line.

In some embodiments, the first plurality of radiation elements, and/or the second plurality of radiation elements is coplanar with respect to each other and include branches of radiation elements, where each branch comprises a group of radiation elements and radiation elements in each group of radiation elements have a same operating frequency band.

In some embodiment, a layer may comprise multiple antenna element groups. Antennas in each group may be microline, and may have dimensions selected for operation in a certain frequency band. Antenna elements from two different groups may be connected to each other at the coupling arm or the feeding arm, e.g., as depicted in FIGS. 1, 5, 6, 8 and 10.

In some embodiments, a mobile wireless device, e.g., a smartphone as depicted in FIG. 13 or FIG. 14, may include a multiband antenna that includes a plurality of radiation elements, wherein each radiation element is a conductive trace on a semiconductor substrate layer, having a width no more than 0.1 millimeter, each radiation element designed to maximize reception or transmission gain at a tuning frequency, a single pole multiple throw (SPxT) switch that electrically connects the multiband antenna with a signal feeding line, a plurality of duplexers or bandpass filters to filter radio frequency (RF) signals received from or transmitted from the multiband antenna in a corresponding operational frequency bands, RF transceiver circuitry to process a received RF signal or to process a baseband signal for transmission over at least one of the multiple frequency bands, and a communication digital signal processor that couples to the RF transceiver circuitry for extracting information from the received RF signal processed by the RF transceiver circuitry, or modulating information on to an RF signal for transmission.

In some embodiments, each of the plurality of the radiation elements transmits and receives the RF signal in a frequency spectrum corresponding to a passband of the radiation element.

In some embodiments, each of the plurality of radiation elements has a slightly different length and resonant frequency.

In some embodiments, an operational bandwidth of the mobile wireless device is an accumulation of resonant frequencies of each of the plurality of radiation elements.

In some embodiments, a radiation element of the multiband antenna is one of a folded monopole, a loop-type, an inverted-F type, a π-shaped, and any combination thereof.

In some embodiments, the multiband radio frequency signals are electromagnetically coupled from the multiband antenna with the signal trace of SPxT switch through a stacked micro-via cross the multiple substrates of the antenna.

In some embodiments, the micro-via has a diameter of not greater than 0.1 millimeter and is filled with a conductive material.

In some embodiments, the wireless device may also include an impedance matching RF circuit between a feeding line of the multiband antenna and the SPxT switch.

In some embodiments, the impedance matching RF circuit comprises one of the discrete components of capacitors or inductors, transmission line stubs, and a circuit switch with tuneable discrete components.

In some embodiments, the multiband antenna has a common grounding arm that electrically connects with an electrical ground using stacked micro-via cross multiple substrates of the multiband antenna.

In some embodiments, the grounding arm includes one of a tuneable capacitor, and an SPxT switch loaded with capacitors of different values so that a resonant frequency of each radiation elements is reconfigurable.

In some embodiments, the transmitted and received multiband radio frequency signals include a combination of at least some of the following radio frequency bands: CDMA bands, GSM bands, WCDMA bands, TD-SCDMA bands, FDD LTE bands, TDD LTE bands, GPS bands, Wi-Fi and Bluetooth bands.

In some embodiments, the multiband antenna is for use as a secondary antenna for multiple-in-multiple-out (MIMO) or frequency diversity or a space diversity application.

In some embodiments, a wireless device e.g., a smartphone as depicted in FIG. 13 or FIG. 14, includes a multiband antenna that includes a plurality of radiation elements, wherein each radiation element is a conductive trace on a dielectric substrate layer, having a width no more than 0.1 millimeter, each radiation element designed to maximize reception or transmission gain at a tuning frequency, a primary display, at least a secondary display towards a bottom portion of the device, and a visually transparent or translucent housing at least on a back side of the bottom portion of the device.

In some embodiments, the multiband antenna is placed on the back side of the bottom portion of the device, and wherein the multiband antenna comprises of multiple multi-layered transparent or translucent substrates.

In some embodiments, the multiband antenna includes a visual transparent or translucent upper cover to protect the conductive radiation element traces.

In some embodiments, the micro-via couples the plurality of radiation elements to the feeding line.

In some embodiments, the multiband antenna comprises a common grounding arm that electrically connects to an electrical ground by using a stacked micro-via across the dielectric substrate layer.

In some embodiments, the micro-via has a diameter of not greater than 0.1 millimeter and is filled with a conductive material.

In some embodiments, each radiation element of the multiband antenna is one of a folded monopole, a loop-type, an inverted-F type, and a π-shaped antenna.

In some embodiments, a mobile wireless device includes a device housing, a display fitted on a front side of the device housing, a multiband antenna comprising a plurality of radiation elements, each radiation element with a conductive trace width no more than 0.1 millimeter, the multiband antenna being for transmission and reception of signals in multiple radio frequency (RF) bands, a transparent or translucent aperture in the bottom portion of the device housing, and there are transparent or translucent layers in the front and back of the opening aperture, and a visual transparent or translucent housing at least in the back side of the bottom portion of the device.

In some embodiments, the multiband antenna comprising of at least a plurality of radiation elements and each of the elements has a slightly different length and corresponding resonant frequency.

In some embodiments, the operation bandwidth of the plurality of the radiation elements is the accumulation of that of the plurality of the radiation elements.

In some embodiments, the multiband antenna is placed in the back side of the bottom portion of the device, and comprises of multi-layered transparent or translucent substrates.

In some embodiments, the multiband antenna may have a visual transparent or translucent upper cover to protect the conductive radiation element traces.

In some embodiments, at least one of the light-based proximity detection sensor, light-based ranging sensor, ambient light sensor, luminance sensor, color sensor is embedded in the transparent or translucent small opening.

In some embodiments, the light-based sensors connects with the processor of the device and could be configured to have real-time application.

In some embodiments, at least a light-emitting diode (LED) could be embedded in the transparent or translucent small opening aperture. The LED connects with the processor of the device and could be configured to have real-time application.

While this patent document contains many specifics, these should not be construed as limitations on the scope of an invention that is claimed or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Only a few examples and implementations are disclosed. Variations, modifications, and enhancements to the described examples and implementations and other implementations can be made based on what is disclosed.

The invention claimed is:

1. An antenna apparatus for use in a wireless receiver, comprising:

a first substrate;

a second substrate under the first substrate;

a base substrate under the second substrate;

a first layer on top of the first substrate;

a second layer under the first substrate in a first planar region between the first substrate and the second substrate;

a third layer under the second substrate in a second planar region between the second substrate and the base substrate;

a first plurality of radiation elements positioned on the first layer;

a second plurality of radiation elements positioned on the second layer;

a signal feeding line on the third layer, the signal feeding line being electrical coupled to the first plurality of radiation elements and the second plurality of radiation elements; and a partial ground plane on an underside of the base substrate.

2. The antenna apparatus of claim 1, wherein each radiation element from the first plurality of radiation elements has a width not greater than 0.2 millimeter.

3. The antenna apparatus of claim 1, wherein at least some of the first plurality of radiation elements have lengths different from each other.

4. The antenna apparatus of claim 1, wherein at least some of the first plurality of radiation elements have differing resonant frequencies.

5. The antenna apparatus of claim 1, wherein the first plurality of radiation elements have resonant frequencies in a first frequency band, and the second plurality of radiation elements have resonant frequencies in a second frequency band that is different from the first frequency band.

6. The antenna apparatus of claim 1, wherein the first plurality of radiation elements are electrically coupled to a first common connected feeding arm, and the second plurality of radiation elements are electrically coupled to a second common connected feeding arm.

7. The antenna apparatus of claim 6, wherein the signal feeding line is electrically coupled with the first common connected feeding arm through a first trans-through micro-via and the second common connected feeding arm through a second trans-through micro-via.

8. The antenna apparatus of claim 7, wherein the first trans-through micro-via and the second trans-through micro-via each has a diameter of not greater than 0.1 millimeter and is filled with a conductive material.

9. The antenna apparatus of claim 1, wherein:

the first plurality of radiation elements are electrically connected to a first common coupling arm;

the second plurality of radiation elements are electrically connected to a second common coupling arm; and the signal feeding line includes a coupling pad at an end to electromagnetically couple the signal feeding line to the first plurality of radiation elements and the second plurality of radiation elements.

10. The antenna apparatus of claim 1, further including:

a first common grounding arm to electrically connect the first plurality of radiation elements to the partial ground plane through a first trans-through micro-via between the first substrate layer and the base substrate; and a second common grounding arm to electrically connect the second plurality of radiation elements to the partial ground plane through a second trans-through micro-via between the second substrate and the base substrate.

11. The antenna apparatus of claim 10, wherein the first trans-through micro-via and the second trans-through via each has a diameter no greater than 0.1 millimeter and is filled with a conductive material.

12. The antenna apparatus of claim 1, wherein at least one of the first plurality of radiation elements or the second plurality of radiation elements is a folded monopole having a length equal to a quarter of wavelength of an operational frequency; and wherein radiation elements from the first plurality of radiation elements or the second plurality of radiation elements have passbands with a plurality of different operational frequencies to cover a desired operational frequency bandwidth.

13. The antenna apparatus of claim 1, wherein at least one of the first plurality of radiation elements or the second plurality of radiation elements is a conductive loop having a length equal to a wavelength of an operational frequency, and wherein radiation elements from the first plurality of radiation elements or the second plurality of radiation elements have different resonant frequencies that are staggered to cover a desired operational frequency bandwidth.

14. The antenna apparatus of claim 13, wherein the conductive loop is electrically connected to a common feeding arm at one end and a common grounding arm at another end, and wherein the common feeding arm is electrically connected to the signal feeding line and the common grounding arm is electrically connected to the partial ground plane by a trans-through micro-via between the first substrate or the second substrate and the base substrate.

15. The antenna apparatus of claim 14, wherein the trans-through micro-via has a diameter not greater than 0.1 millimeter and is filled with a conductive material.

16. The antenna apparatus of claim 1, wherein at least one of the first plurality of radiation elements or the second plurality of radiation elements is an inverted-F antenna having a length equal to a quarter of wavelength of an operational frequency, and radiation elements from at least some of the first plurality of radiation elements or the second plurality of radiation elements have different resonant frequencies that are staggered to cover a desired operational frequency bandwidth.

17. The antenna apparatus of claim 16, wherein the inverted-F radiation element is electrically connected to a common feeding arm at one end and a common grounding arm at another end, and wherein the common feeding arm is electrically connected to the signal feeding line and the common grounding arm is electrically connected to the partial ground plane by a trans-through micro-via between the first substrate or the second substrate and the base substrate.

18. The antenna apparatus of claim 17, wherein the trans-through micro-via has a diameter not greater than 0.1 millimeter and is filled with a conductive material.

19. The antenna apparatus of claim 18, wherein each of the first plurality of radiation elements and the second plurality of radiation elements is an inverted-F radiation element having a unique operational frequency to provide a multi-band operational frequency coverage by the antenna apparatus.

20. The antenna apparatus of claim 1, wherein at least one of the first plurality of radiation elements or the second plurality of radiation elements is a π-shaped element having a unique length and resonant frequency, in order to cover a desired operational frequency bandwidth by combination of the resonant frequencies of the first plurality of radiation elements or the second plurality of radiation elements.

21. The antenna apparatus of claim 20, wherein at least one of the first plurality of radiation elements or the second plurality of radiation elements is connected to a common feeding arm at one end and a common grounding arm at another end, and wherein the common feeding arm is electrically connected to the signal feeding line and the common grounding arm is electrically connected to the partial ground plane by a trans-through micro-via between the first substrate or the second substrate and the base substrate.

22. The antenna apparatus of claim 21, wherein the trans-through micro-via has a diameter not greater than 0.1 millimeter and is filled with a conductive material.

23. The antenna apparatus of claim 21, wherein the desired operational frequency bandwidth comprises multiple frequency bands of operation.

24. The antenna apparatus of claim 1, further comprising:

an impedance matching radio frequency circuit that provides frequency-dependent impedance matching for multiband operation of the antenna apparatus.

25. The antenna apparatus of claim 24, wherein the impedance matching radio frequency circuit comprises one of a circuit with discrete capacitors or inductors, a circuit with transmission line stubs, and a circuit switch with tuneable discrete components.

26. The antenna apparatus of claim 1, further including a frequency tuneable circuit to make an operational band of the antenna apparatus adjustable;

wherein the frequency tuneable circuit comprises one of a tuneable capacitor and a single-pole-multiple-throw (SPxT) switch loaded with capacitors of different values.

27. The antenna apparatus of claim 1, further comprising additional antenna substrate layers positioned on top of the first substrate, wherein the each of the additional antenna layers includes a plurality of conductive radiation elements and are electromagnetically coupled to the signal feeding line.

28. The antenna apparatus of claim 1, wherein the first plurality of radiation elements are coplanar with respect to each other and include branches of radiation elements, wherein each branch comprises a group of radiation elements and radiation elements in each group of radiation elements have a same operating frequency band.

29. A mobile wireless device, comprising:

a multiband antenna that includes a plurality of radiation elements, wherein each radiation element is a conductive trace on a dielectric substrate layer, having a width no more than 0.1 millimeter, each radiation element designed to maximize reception or transmission gain at a tuning frequency;

a single pole multiple throw (SPxT) switch that electrically connects the multiband antenna with a signal feeding line;

a plurality of duplexers or bandpass filters to filter radio frequency (RF) signals received from or transmitted from the multiband antenna in a corresponding operational frequency bands;

RF transceiver circuitry to process a received RF signal or to process a baseband signal for transmission over at least one of the multiple frequency bands; and a communication digital signal processor that couples to the RF transceiver circuitry for extracting information from the received RF signal processed by the RF transceiver circuitry, or modulating information on to an RF signal for transmission.

30. The mobile wireless device of claim 29, wherein each of the plurality of the radiation elements transmits and receives the RF signal in a frequency spectrum corresponding to a passband of the radiation element.

31. The mobile wireless device of claim 29, wherein each of the plurality of radiation elements has a slightly different length and resonant frequency.

32. The mobile wireless device of claim 31, wherein an operational bandwidth of the mobile wireless device is an accumulation of resonant frequencies of each of the plurality of radiation elements.

33. The mobile wireless device of claim 29, wherein a radiation element of the multiband antenna is one of a folded monopole, a loop-type, an inverted-F type, π-shaped, and any combination thereof.

34. The mobile wireless device of claim 29, wherein the multiband radio frequency signals are electromagnetically coupled from the multiband antenna with the signal trace of SPxT switch through a stacked micro-via cross the multiple substrates of the antenna.

35. The mobile wireless device of claim 34, wherein the micro-via has a diameter of not greater than 0.1 millimeter and is filled with a conductive material.

36. The mobile wireless device of claim 29, further including:

an impedance matching RF circuit between a feeding line of the multiband antenna and the SPxT switch.

37. The mobile wireless device of claim 36, wherein the impedance matching RF circuit comprises one of: of discrete components of capacitors or inductors, transmission line stubs, and a circuit switch with tuneable discrete components.

38. The mobile wireless device of claim 29, wherein the multiband antenna has a common grounding arm that electrically connects with an electrical ground using stacked micro-via cross multiple substrates of the multiband antenna.

39. The mobile wireless device of claim 38, wherein the micro-via has a diameter of not greater than 0.1 millimeter and is filled with a conductive material.

40. The mobile wireless device of claim 38, wherein the grounding arm includes one of a tuneable capacitor, and an SPxT switch loaded with capacitors of different values so that a resonant frequency of each radiation elements is reconfigurable.

41. The mobile wireless device of claim 29, wherein the transmitted and received multiband radio frequency signals include a combination of at least some of the following radio frequency bands: CDMA bands, GSM bands, WCDMA bands, TD-SCDMA bands, FDD LTE bands, TDD LTE bands, GPS bands, Wi-Fi and Bluetooth bands.

42. The mobile wireless device of claim 29, wherein the multiband antenna is for use as a secondary antenna for multiple-in-multiple-out (MIMO) or frequency diversity or a space diversity application.

43. A mobile wireless device, comprising:

a multiband antenna that includes a plurality of radiation elements, wherein each radiation element is a conductive trace on a dielectric substrate layer, having a width no more than 0.1 millimeter, each radiation element designed to maximize reception or transmission gain at a tuning frequency;

a primary display;

at least a secondary display towards a bottom portion of the device; and a visually transparent or translucent housing at least on a back side of the bottom portion of the device.

44. The mobile wireless device of claim 43, wherein the multiband antenna is placed on the back side of the bottom portion of the device, and wherein the multiband antenna comprises of multiple multi-layered transparent or translucent substrates.

45. The mobile wireless device of claim 43, wherein the multiband antenna includes a visual transparent or translucent upper cover to protect conductive radiation element traces.

46. The mobile wireless device of claim 43, wherein the multiband antenna comprises a coupling arm of width not greater than 0.1 millimeter that electromagnetically couples the plurality of radiation elements with a feeding line.

47. The mobile wireless device of claim 43, wherein the multiband antenna comprises a feeding arm of width no greater than 0.1 millimeter, and at least a stacked micro-via with diameter not greater than 0.1 millimeter and filled with a conductive material.

48. The mobile wireless device of claim 47, wherein the micro-via couples the plurality of radiation elements to the feeding line.

49. The mobile wireless device of claim 43, wherein the multiband antenna comprises a common grounding arm that electrically connects to an electrical ground by using a stacked micro-via across the semiconductor substrate layer.

50. The mobile wireless device of claim 49, wherein the micro-via has a diameter of not greater than 0.1 millimeter and is filled with a conductive material.

51. The mobile wireless device of claim 43, wherein each radiation element of the multiband antenna is one of a folded monopole, a loop-type, an inverted-F type, and a π-shaped antenna.

52. A mobile wireless device, comprising:

a device housing;

a display fitted on a front side of the device housing;

a multiband antenna comprising a plurality of radiation elements, each radiation element with a conductive trace width no more than 0.1 millimeter, the multiband antenna being for transmission and reception of signals in multiple radio frequency (RF) bands;

a transparent or translucent aperture in the bottom portion of the device housing, and there are transparent or translucent layers in the front and back of the opening aperture; and a visual transparent or translucent housing at least in the back side of the bottom portion of the device.

53. The mobile wireless device of claim 52, wherein the multiband antenna comprising of at least a plurality of radiation elements and each of the elements has a slightly different length and corresponding resonant frequency.

54. The mobile wireless device of claim 52, wherein the operation bandwidth of the plurality of the radiation elements is the accumulation of that of the plurality of the radiation elements.

55. The mobile wireless device of claim 52, wherein the multiband antenna is placed in the back side of the bottom portion of the device, and comprises of multi-layered transparent or translucent substrates.

56. The mobile wireless device of claim 52, wherein the multiband antenna may have a visual transparent or translucent upper cover to protect the conductive radiation element traces.

57. The mobile wireless device of claim 52, wherein at least one of the light-based proximity detection sensor, light-based ranging sensor, ambient light sensor, luminance sensor, color sensor is embedded in the transparent or translucent small opening.

58. The mobile wireless device of claim 57, wherein the light-based sensors connects with the processor of the device and could be configured to have real-time application.

59. The mobile wireless device of claim 52, wherein at least a light-emitting diode (LED) could be embedded in the transparent or translucent small opening aperture. The LED connects with the processor of the device and could be configured to have real-time application.

* * * * *